US007991326B2

(12) United States Patent
Ehara et al.

(10) Patent No.: US 7,991,326 B2
(45) **Date of Patent: *Aug. 2, 2011**

(54) IMAGE FORMING APPARATUS HAVING ENHANCED CONTROLLING METHOD FOR REDUCING DEVIATION OF SUPERIMPOSED IMAGES

(75) Inventors: Yasuhisa Ehara, Kamakura (JP); Kazuhiko Kobayashi, Tokyo (JP); Joh Ebara, Kamakura (JP); Noriaki Funamoto, Machida (JP); Seichi Handa, Tokyo (JP); Yuji Matsuda, Inagi (JP)

(73) Assignee: Ricoh Company, Ltd., Tokyo (JP)

( * ) Notice: Subject to any disclaimer, the term of this patent is extended or adjusted under 35 U.S.C. 154(b) by 830 days.

This patent is subject to a terminal disclaimer.

(21) Appl. No.: 11/635,550

(22) Filed: Dec. 8, 2006

(65) Prior Publication Data

US 2007/0140736 A1 Jun. 21, 2007

(30) Foreign Application Priority Data

Dec. 9, 2005 (JP) ..... 2005-357037

(51) Int. Cl.
*G03G 15/00* (2006.01)

(52) U.S. Cl. ..... 399/167; 399/301

(58) Field of Classification Search ..... 399/159, 399/167, 301, 302

See application file for complete search history.

(56) References Cited

U.S. PATENT DOCUMENTS 5,196,925 A * 3/1993 Takanashi et al.
5,995,802 A * 11/1999 Mori et al. ..... 399/301
6,049,690 A 4/2000 Nakayasu et al.
2003/0128995 A1* 7/2003 Ishii et al.
2005/0031361 A1* 2/2005 Kobayashi
2005/0047834 A1 3/2005 Tomita et al.
2005/0207799 A1 9/2005 Ebara

FOREIGN PATENT DOCUMENTS

| | | |
|---|---|---|
| EP | 1510875 | 3/2005 |
| JP | 63-286864 | 11/1988 |
| JP | 09-146329 | 6/1997 |
| JP | 10-003188 | 1/1998 |
| JP | 10-078734 | 3/1998 |
| JP | 2000-284561 | 10/2000 |
| JP | 2005-202432 | 7/2005 |

OTHER PUBLICATIONS

European Search Report dated Apr. 23, 2007.

* cited by examiner

*Primary Examiner* — David P Porta
*Assistant Examiner* — Milton Gonzalez
(74) *Attorney, Agent, or Firm* — Harness, Dickey & Pierce, P.L.C.

(57) ABSTRACT

An image forming apparatus is disclosed. In at least one embodiment, the apparatus includes a plurality of image carriers to carry an image; a plurality of drivers to drive the image carriers; a plurality of drive-force transmitting members to transmit a driving-force from the drivers to image carriers; a developing unit, provided to the image carriers, to develop the image; a transfer member, facing the image carriers, to receive the image from the image carriers sequentially; an image detector to detect the image on the transfer member to check a detection timing of the image; a sensor, provided to each of the image carriers, to detect a rotational speed of image carriers; and a controller to conduct an image-to-image displacement control, a speed-deviation checking, and a phase adjustment control for each of the plurality of image carriers with the image detector and sensor.

15 Claims, 14 Drawing Sheets

IMAGE FORMING APPARATUS HAVING ENHANCED CONTROLLING METHOD FOR REDUCING DEVIATION OF SUPERIMPOSED IMAGES

PRIORITY STATEMENT

This application claims priority under 35 U.S.C. §119 upon Japanese patent application No. 2005-357037 filed on Dec. 9, 2005, the entire contents and disclosure of which is hereby incorporated herein by reference.

TECHNICAL FIELD

The present disclosure generally relates to an image forming apparatus, and more particularly to an image forming apparatus having a plurality of image carriers for superimposingly transferring a plurality of images to a transfer member such as intermediate transfer belt and recording medium.

BACKGROUND

An image forming apparatus using electrophotography may include a plurality of image carriers such as photoconductor, and a transfer member (e.g., transfer belt) facing the image carriers. The transfer member may travel in an endless manner in one direction.

In such an image forming apparatus, toner images having different color may be formed on each of the image carriers.

Such toner images may be superimposingly transferred onto the transfer member, and then transferred onto a recording medium (e.g., sheet), by which a full-color toner image may be formed on the recording medium.

In such a configuration, sometimes, toner images may not be correctly superimposed on the recording sheet by several factors. Such factors may include a deviation of light-path in an optical unit that scans the image carriers due to a temperature change, relative positional change of the image carriers due to an external force, for example.

If toner images may not be correctly superimposed on a recording medium when forming a fine/precise image by superimposing a plurality of color toner images, image dots having different color may not be correctly superimposed on the recording medium, by which a resultant image may have a blurred portion, which may not be acceptable as fine/precise image.

Furthermore, if such incorrect superimposing may occur when forming a character image on a non-white sheet, a white area may occur around the character image.

Furthermore, if such incorrect superimposing may occur when forming an image having a plurality of colored areas on a sheet, a white area may occur at a border of different colored areas or an unintended color image area may occur at a border of different colored areas.

Furthermore, if such incorrect superimposing may occur when forming an image having a plurality of colored areas on a sheet, unintended stripe images may occur on a sheet, and cause uneven concentration on an image, which is printed on the sheet.

Such phenomenon may unpreferably degrade an image quality to be formed on the recording medium.

Adjusting a writing timing of an optical unit of an image forming apparatus may reduce such drawbacks. Hereinafter such drawbacks may be referred to "superimposing-deviation of images" or "superimposing-deviation" as required.

An adjustment of writing timing of the optical unit may be conducted as below.

At first, a toner image may be formed on each of the image carriers (e.g., photoconductor) at a given timing, and then transferred onto to a surface of a transfer member such as transfer belt as detection image.

Such detection images may be used to detect an image-to-image positional deviation between toner images, to be formed on the transfer member.

A photosensor may sense the detection images and transmits a signal, corresponding to the detection image, to a controller of the image forming apparatus. The controller may judge a detection timing of the detection image based on the signal.

The controller may compute a relative image-to-image positional deviation value between each of the toner images based on the signal.

Based on a computed value by the controller, the controller may set an optical-writing starting timing for each of the image carriers (e.g., photoconductor) independently, by which a superimposing-deviation of images may be suppressed.

The above-mentioned image forming apparatus may employ a direct transfer method, which transfers toner images from image carriers to a recording medium, which may be transported by a transport belt.

In addition, the above-mentioned image forming apparatus may also employ an intermediate transfer method, which transfers toner images from image carriers to a transfer belt, and then to a recording medium. Even in such configuration, a superimposing-deviation of images may be reduced by adjusting a writing timing of an optical unit in a similar manner.

Toner images may not be correctly superimposed on the recording medium by the above-mentioned factors such as a deviation of light-path in an optical unit due to a temperature change, and relative positional changes of the image carriers due to an external force, for example.

In addition to such factors, other factors may cause an incorrect superimposing of toner images.

Other factors may include an eccentricity of image carrier, an eccentricity of drive-force transmitting member (e.g., gear) that rotates with image carrier, and an eccentricity of a coupling that is connected to image carrier, for example.

Specifically, if the image carrier or drive-force transmitting member may have an eccentricity, the image carrier may have two areas (e.g., first and second areas) on the surface of the image carrier with respect to a diameter direction of the image carrier.

For example, the first area of the image carrier may rotate with a relatively faster speed due to the eccentricity, and the second area of the image carrier may rotate with a relatively slower speed due to the eccentricity, wherein such first and second areas may be distanced each other with 180-degree with respect to a diameter direction of the image carrier, for example.

In such a case, first image dots formed on the first area of the image carrier may be transferred to a transfer member at a timing earlier than an optimal timing, and a second image dots formed on the second area of the image carrier may be transferred to the transfer member at a timing later than an optimal timing.

If such phenomenon may occur, first image dots formed on one image carrier may be superimposed on second image dots formed on another image carrier. Similarly, second image dots formed on one image carrier may be superimposed with first image dots formed on another image carrier.

Such phenomenon may cause incorrect superimposing of toner images having different colors.

In another image forming apparatus, a controller may conduct a speed-deviation checking and a phase adjustment control for toner images to reduce an incorrect superimposing of toner images.

The speed-deviation checking may be conducted by detecting a deviation of surface speed of an image carrier (e.g. photoconductor) when conducting an image forming operation.

The phase adjustment control may be conducted by adjusting a phase of each image carrier based on the speed-deviation checking.

In case of speed-deviation checking, a plurality of toner images may be formed with a given pitch each other on a surface of image carrier in a surface moving direction of the image carrier.

Such plurality of toner images may be then transferred to a transfer member (e.g., transfer belt) as speed-deviation checking image, and a photosensor may detect each of the toner images included in the speed-deviation checking image.

Based on a detection result by the photosensor, a pitch of toner images included in the speed-deviation checking image may be computed.

Bead on the computed pitch, a speed deviation per one revolution of each of image carriers may be determined.

Furthermore, another photosensor may detect a marking placed on a gear, which rotates the image carrier, to detect a timing that the image carrier comes to a given rotational angle.

With such process, the controller of the image forming apparatus may compute a difference between a first timing when the image carrier comes to the given rotational angle and a second timing when the surface speed of image carrier becomes a maximum or minimum speed.

Such process may be conducted for each of the image carriers.

After conducting such speed-deviation checking, a phase adjustment control may be conducted to adjust a phase of image carriers.

Specifically, a photosensor may detect a marking placed on a given position of a gear, which rotates the image carrier.

A plurality of photosensors may be used to detect a marking placed on a given position of gears, which rotates respective image carriers.

With such process, a timing when each of the image carriers becomes a given rotational angle may be detected.

Based on such information including rotational angle and speed-deviation of the respective image carriers, a plurality of drive motors, which respectively drives each of the image carriers, is driven by changing a driving time period temporarily to adjust a phase of image carriers.

With such phase adjustment of image carriers, image dots that may come to a transfer position at an earlier timing than an optimal timing, or image dots that may come to a transfer position at a later timing than an optimal timing, may come to a transfer position at an optimal timing.

With such controlling, a superimposing-deviation of images may be reduced.

Furthermore, if a pitch between adjacent image carriers may be set to a value, which is equal to a length obtained by multiplying a circumference length of image carrier with an integral number (e.g., one, two, three), each of the image carriers may rotate for an integral number (e.g., one, two, three) during a time when one toner image is transferred from one image carrier to a sheet at one transfer position and is moved to a next transfer position on a next image carrier.

Accordingly, by adjusting a phase difference of image carriers to substantially "zero" level, image dots may be preferably transferred to a transfer member at each transfer position.

On one hand, if a pitch between adjacent image carriers may not be set to a value, which is equal to a length obtained by multiplying a circumference length of image carrier with an integral number (e.g., one, two, three), each of the image carriers may not rotate for an integral number (e.g., one, two, three) during a time when one toner image is transferred from one image carrier to a sheet at one transfer position and is moved to a next transfer position on a next image carrier. In such a case, a different phase may be set for each of the image carriers respectively, by which image dots may be transferred to a transfer member from each of the image carriers at each transfer position defined by the transfer member and the each of the image carriers.

In view of such background, the inventors of this particular disclosure experimentally made a prototype image forming apparatus, which may conduct the above-explained adjustment control for writing timing of an optical unit, speed-deviation checking, and phase adjustment control. The inventors assumed that a superimposing-deviation of toner images may be effectively reduced by combining the above-mentioned controls.

However, such prototype apparatus showed a relatively greater superimposing-deviation of toner images in some experiments.

Such relatively greater superimposing-deviation of toner images may be caused as below.

A speed deviation per one revolution of an image carrier may be caused by an eccentricity of image carrier or drive-force transmitting member (e.g., gear), in general.

Therefore, when the image carrier or drive-force transmitting member may be replaced with a new one, a speed deviation per one revolution of image carrier or drive-force transmitting member may change.

Specifically, when a sensor detects a replacement of image carrier, a writing timing of an optical unit may be adjusted. Then, a phase of the each image carrier may be adjusted by a speed-deviation checking and phase adjustment control.

However, if such controls are conducted when the image carrier or drive-force transmitting member is replaced, a superimposing-deviation of images may become worse inversely.

Specifically, a writing timing of an optical unit, which may be adjusted to reduce a superimposing-deviation of images, may be determined based on a detection result of superimposing-deviation of images.

If one of the image carriers is replaced before adjusting a writing timing of an optical unit, a phase difference of image carriers may become unpreferable value due to such replacement.

Then, under the above-mentioned unpreferable condition of phase difference of image carriers, toner images may be formed on each of the image carriers.

Such toner images may be used for detecting a superimposing-deviation of toner images, and a writing timing of an optical unit may be adjusted based on the detected superimposing-deviation of toner images.

However, as above-mentioned, each of the image carriers may be in an unpreferable phase relationship with each other.

If a speed-deviation checking and phase adjustment control may be conducted after determining the writing timing of the optical unit under such unpreferable phase relationship for the image carriers, a following phenomenon may unpreferable occur.

Specifically, the writing timing of the optical unit, which is adjusted in earlier timing, may be unintentionally changed to unpreferable value by conducting the speed-deviation checking and phase adjustment control, by which superimposing-deviation of images may become worse.

SUMMARY

The present disclosure relates to an image forming apparatus. The image forming apparatus includes, in at least one embodiment, a plurality of image carriers, a plurality of drivers, a plurality of drive-force transmitting members, a developing unit, a transfer member, an image detector, a sensor, and a controller.

The plurality of image carriers carry an image thereon. The plurality of drivers drives each of the plurality of image carriers. The plurality of drive-force transmitting members transmits a driving-force from the plurality of drivers to the plurality of image carriers. The developing unit, provided to each of the plurality of image carriers, develops the image on each of the plurality of image carriers. The transfer member, facing the plurality of image carriers, receives the developed image from each of the plurality of image carriers sequentially while endlessly moving in a given direction.

The image detector detects the developed image formed on the transfer member to check a detection timing of the developed image. The sensor, provided to each of the plurality of image carriers, senses a rotational speed of each of the plurality of image carriers and determines a rotational angle of each of the plurality of image carriers. The controller conducts an image-to-image displacement control, a speed-deviation checking, and a phase adjustment control.

The image-to-image displacement control includes an image forming of a detection image on the transfer member, a detection of the developed image in the detection image with the image detector, and an adjustment of image forming timing on each of the plurality of image carriers.

The speed-deviation checking includes an image forming of a speed-deviation checking image on the transfer member transferred from each of the plurality of image carriers, the speed-deviation checking image including the developed image transferred from each of the plurality of image carriers, detecting of the speed-deviation checking image with the image detector, determining a speed-deviation of each of the plurality of image carriers per one revolution based on a result detected by the image detector and a result detected by the sensor.

The phase adjustment control includes a phase adjustment of each of the plurality of image carriers based on a result determined by the speed-deviation checking.

The controller sequentially conducts the phase adjustment control and the image-to-image displacement control before conducting an image forming operation on each of the plurality of image carriers.

The present disclosure also relates to a method of adjusting an image forming timing on a plurality of image carriers for use in an image forming apparatus.

The method includes, in at least one embodiment, forming, transferring, detecting, sensing, and controlling. The forming step forms an image on each of the plurality of image carriers. The transferring step transfers the image from each of the plurality of image carriers to a transfer member. The detecting step detects the image on the transfer member. The sensing step senses a rotational speed of each of the plurality of image carriers. The controlling step controls an image-to-image displacement checking of the image on the transfer member, a speed-deviation checking of each of the plurality of image carriers, and a phase adjustment control for each of the plurality of image carriers based on a result of the speed-deviation checking and a result of the sensing step. The controlling step conducts the phase adjustment control firstly and the image-to-image displacement checking secondly.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages and features thereof can be readily obtained and understood from the following detailed description of example embodiments with reference to the accompanying drawings, wherein.

Figure 1:
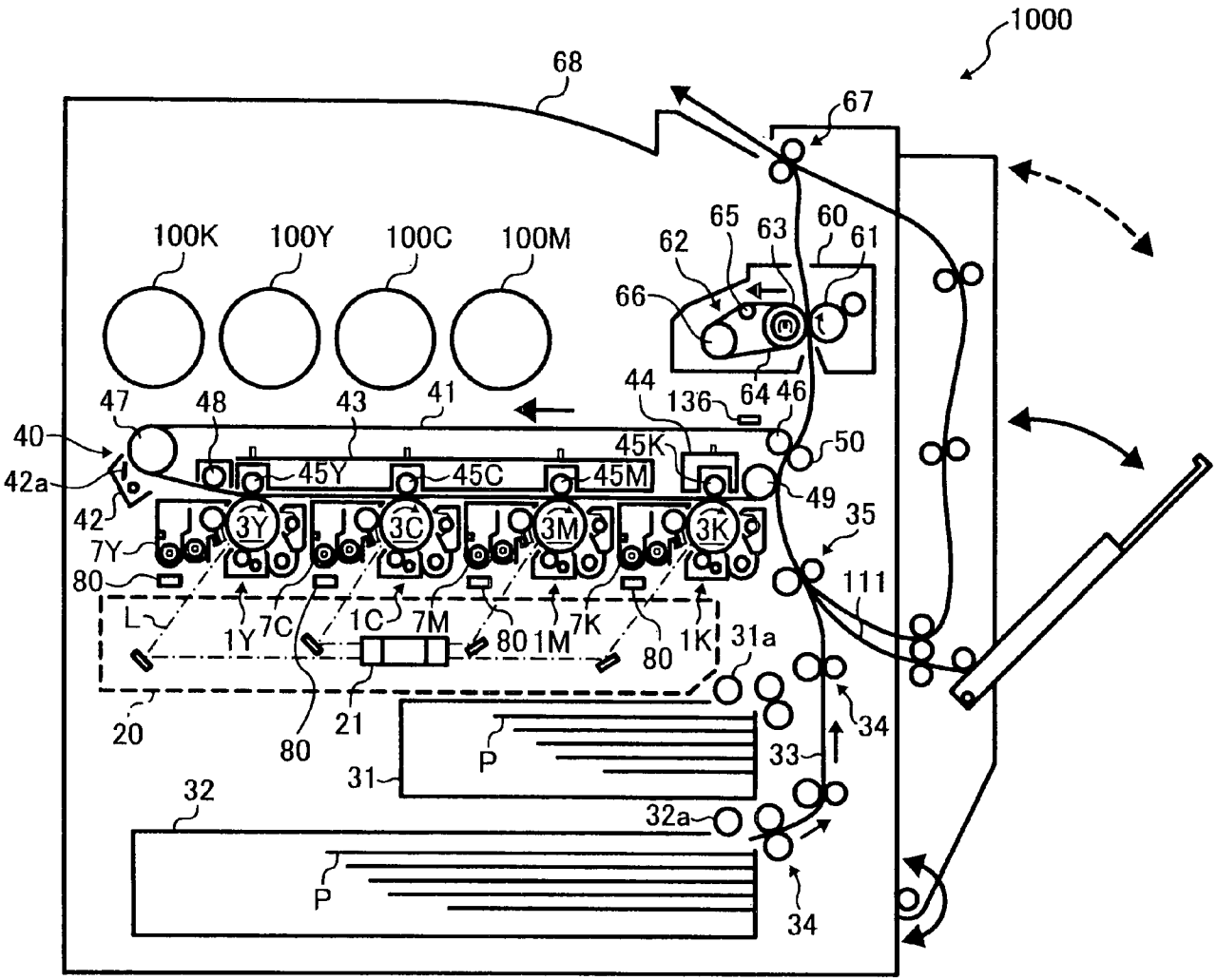
FIG. 1 is a schematic configuration of an image forming apparatus according to an example embodiment.

The accompanying drawings are intended to depict example embodiments of the present invention and should not be interpreted to limit the scope thereof. The accompanying drawings are not to be considered as drawn to scale unless explicitly noted.

DETAILED DESCRIPTION OF EXAMPLE EMBODIMENTS

It will be understood that if an element or layer is referred to as being "on," "against," "connected to" or "coupled to" another element or layer, then it can be directly on, against connected or coupled to the other element or layer, or intervening elements or layers may be present. In contrast, if an element is referred to as being "directly on", "directly connected to" or "directly coupled to" another element or layer, then there are no intervening elements or layers present. Like numbers refer to like elements throughout. As used herein, the term "and/or" includes any and all combinations of one or more of the associated listed items.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

Referring now to the drawings, wherein like reference numerals designate identical or corresponding parts throughout the several views, an image forming apparatus according to an example embodiment is described with particular reference to FIG. 1.

FIG. 1 is a schematic configuration of the image forming apparatus 1000 according to an example embodiment. The image forming apparatus 1000 may be used as a printer, for example, but not limited a printer.

As shown in FIG. 1, the image forming apparatus 1000 may include process units 1Y, 1C, 1M, and 1K, for example.

Each of the process units 1Y, 1C, 1M, and 1K may be used to form a toner image of yellow, magenta, cyan, and black, respectively. Hereinafter, reference characters of Y, C, M, and K are used to indicate each color of yellow, magenta, cyan, and black, as required.

The process units 1Y, 1C, 1M, and 1K may take a similar configuration for forming a toner image except toner colors (i.e., Y, C, M, and K toner).

Figure 2:
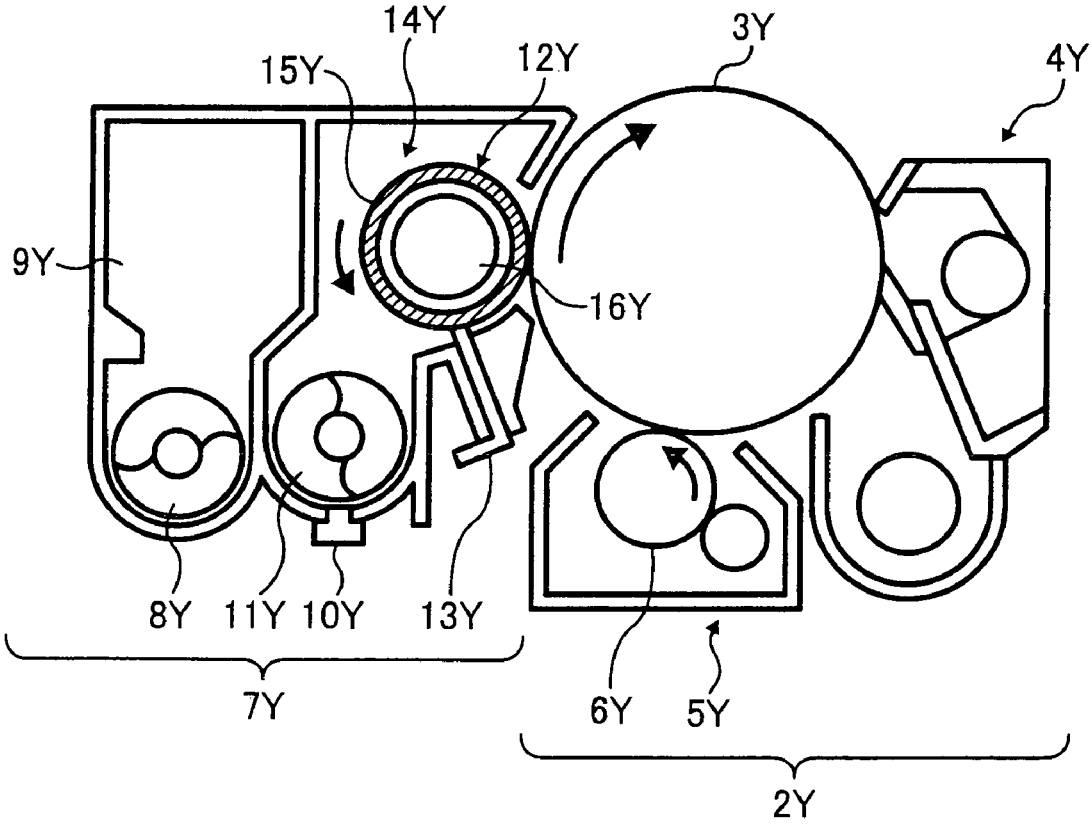
FIG. 2 is a schematic configuration of a process unit of an image forming apparatus of FIG. 1.

For example, the process unit 1Y for forming Y toner image may include a photosensitive unit 2Y, and a developing unit 7Y as shown in FIG. 2.

Figure 3:
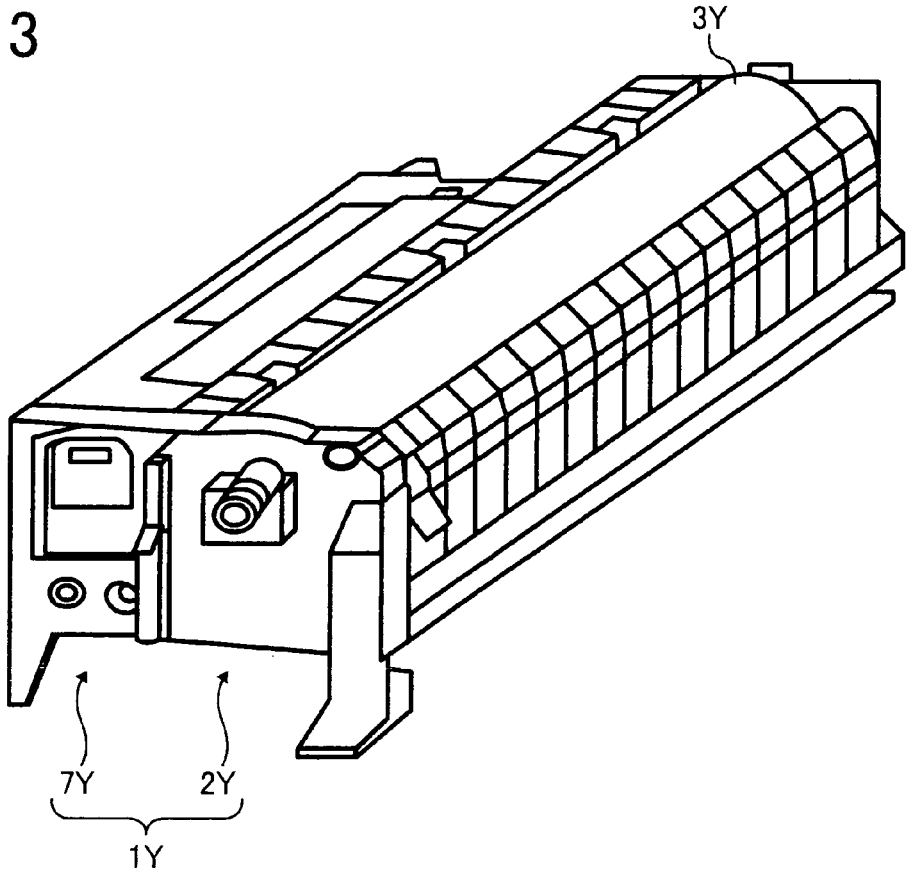
FIG. 3 is a perspective view of a process unit of FIG. 2.

The photosensitive unit 2Y and developing unit 7Y may be integrated as the process unit 1Y as shown in FIG. 3. Such process unit 1Y may be detachable from the image forming apparatus 1000.

Figure 4:
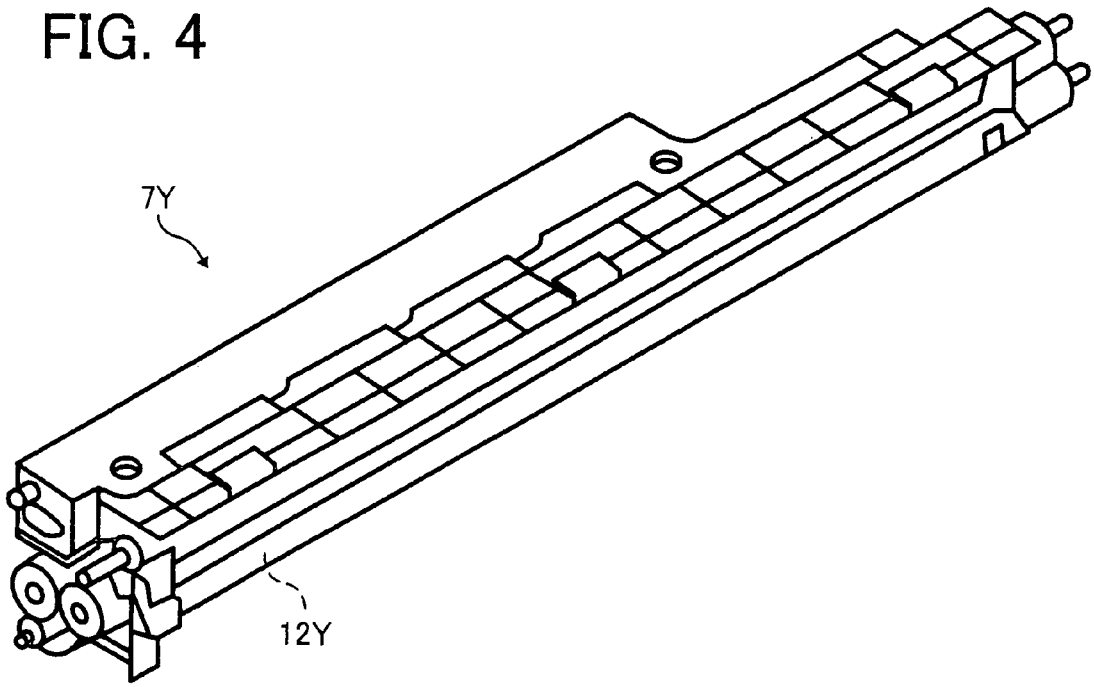
FIG. 4 is a perspective view of a developing unit included in a process unit of FIG. 2.

When the process unit 1Y is removed from the image forming apparatus 1000, the developing unit 7Y may be further detachable from the photosensitive unit 2Y as shown in FIG. 4.

As shown in FIG. 2, the photosensitive unit 2Y may include a photoconductor 3Y, a cleaning unit 4Y, a charging unit 5Y, and a de-charging unit (not shown), for example.

The photoconductor 3Y, used as latent image carrier, may have a drum shape, for example.

The charging unit 5Y may uniformly charge a surface of the photoconductor 3Y, which may rotate in a clockwise direction in FIG. 2 by a driver (not shown).

The charging unit 5Y may include a contact type charger such as charging roller 6Y as shown in FIG. 2, for example.

The charging roller 6Y may be supplied with a charging bias voltage from a power source (not shown), and may rotate in a counter-clockwise direction when to uniformly charge the photoconductor 3Y. Instead of the charging roller 6Y, the charging unit 5Y may include a charging brush, for example.

Furthermore, the charging unit 5Y may include a non-contact type charger such as scorotron charger (not shown) to uniformly charge the photoconductor 3Y.

The surface of the photoconductor 3Y, uniformly charged by the charging unit 5Y, may be scanned by a light beam, emitted from an optical writing unit (to be described later), to form an electrostatic latent image for a yellow image on the photoconductor 3Y.

As shown in FIG. 2, the developing unit 7Y may include a first container 9Y having a first transport screw 8Y therein, for example.

The developing unit 7Y may further include a second container 14Y having a toner concentration sensor 10Y, a second transport screw 11Y, a developing roller 12Y, and a doctor blade 13Y, for example.

The toner concentration sensor 10Y may include a magnetic permeability sensor, for example.

The first container 9Y and second container 14Y may contain a Y-developing agent having magnetic carrier and Y toner. The Y toner may be negatively charged, for example.

The first transport screw 8Y, rotated by a driver (not shown), may transport the Y-developing agent to one end direction of the first container 9Y.

Then, the Y-developing agent may be transported into the second container 14Y through an opening (not shown) of a separation wall, provided between the first container 9Y and second container 14Y.

The second transport screw 11Y, rotated in the second container 14Y by a driver (not shown), may transport the Y-developing agent to one end direction of the second container 14Y.

The toner concentration sensor 10Y, attached to a bottom of the second container 14Y, may detect toner concentration in the Y developing agent, transported in the second container 14Y.

As shown in FIG. 2, the developing roller 12Y may be provided over the second transport screw 11Y while the developing roller 12Y and second transport screw 11Y may be provided in the second container 14Y in a parallel manner.

As shown in FIG. 2, the developing roller 12Y may include a developing sleeve 15Y, and a magnet roller 16Y, for example.

The developing sleeve 15Y may be made of non-magnetic material and formed in a pipe shape, for example. The magnet roller 16Y may be included in the developing sleeve 15Y, for example.

When the developing sleeve 15Y may rotate in a counter-clockwise direction in FIG. 2, a portion of the Y-developing agent, transported by the second transport screw 11Y, may be carried-up to a surface of the developing sleeve 15Y with an effect of magnetic force of the magnet roller 16Y.

Then, the doctor blade 13Y, provided over the developing sleeve 15Y with a given space therebetween, may regulate a thickness of layer of the Y developing agent on the developing sleeve 15Y.

Such thickness-regulated Y developing agent may be transported to a developing area, which faces the photoconductor 3Y, with a rotation of the developing sleeve 15Y.

Then, Y toner in the Y-developing agent may be transferred to an electrostatic latent image formed on the photoconductor 3Y to develop Y toner image on the photoconductor 3Y.

The Y-developing agent, which loses the Y toner by such developing process, may be returned to the second transport screw 11Y with a rotation of the developing sleeve 15Y.

Then, the Y developing agent may be transported by the second transport screw 11Y and returned to the first container 9Y through the opening (not shown) of the separation wall.

The toner concentration sensor 10Y may detect permeability of the Y-developing agent, and transmit a detected permeability to a controller of the image forming apparatus 1000 as voltage signal.

The permeability of Y developing agent may correlate with Y toner concentration in the Y-developing agent.

Accordingly, the toner concentration sensor 10Y may output a voltage signal corresponding to an actual Y toner concentration in the second container 14Y.

The controller may include a RAM (random access memory), which stores a reference value Vtref for voltage signal transmitted from the toner concentration sensor 10Y. The reference value Vtref may be set to a value, which is preferable for developing process.

The reference value Vtref may be set to a preferable toner concentration for each of yellow toner, cyan toner, magenta toner, and black toner.

The RAM (random access memory) may store such preferable toner concentration value as data.

In case of the developing unit 7Y, the controller may compare a reference value Vtref for yellow toner concentration and an actual voltage signal coming from the toner concentration sensor 10Y.

Then, the controller may drive a toner supplier (not shown) for a given time period based on the above-mentioned comparison to supply fresh Y toner to the developing unit 7Y.

With such process, fresh Y toner may be supplied to the first container 9Y, as required, by which Y toner concentration in the Y-developing agent in the first container 9Y may be set to a preferable level after the developing process, which consumes Y toner.

Accordingly, Y toner concentration in the Y-developing agent in the second container 14Y may be maintained at a given range.

Such toner supply control may be similarly conducted for other process units 1C, 1M, and 1K using different color toners with developing agent.

The Y toner image formed on the photoconductor 3Y may be then transferred to an intermediate transfer belt (to be described later).

After transferring Y toner image to the intermediate transfer belt, the cleaning unit 4Y of the photosensitive unit 2Y may remove toner particles remaining on the surface of the photoconductor 3Y.

Then, the de-charging unit (not shown) may de-charge the surface of the photoconductor 3Y to prepare for a next image forming.

A similar transferring process for toner images may be conducted for other process units 1C, 1M, and 1K. Specifically, C, M, and K toner images may be transferred to the intermediate transfer belt from the respective photoconductors 3C, 3M, and 3K, as similar to the photoconductor 3Y.

As shown in FIG. 1, the image forming apparatus 1000 may include an optical writing unit 20 under the process units 1Y, 1C, 1M, and 1K, for example.

The optical writing unit 20 may irradiate a light beam L to each of the photoconductors 3Y, 3C, 3M, and 3K of the respective process units 1Y, 1C, 1M, and 1K based on original image information.

With such process, electrostatic latent images for Y, C, M, and K may be formed on the respective photoconductors 3Y, 3C, 3M, and 3K.

The optical writing unit 20 may irradiate the light beam L to the photoconductors 3Y, 3C, 3M, and 3K with a polygon mirror 21 and other optical parts such as lens and mirror.

The polygon mirror 21, rotated by a motor (not shown), may deflect a light beam coming from a light source (not shown). Such light beam then goes to the optical parts such as lens and mirror.

The optical writing unit 20 may include another configuration such as LED (light emitting diode) array for scanning the photoconductors 3Y, 3C, 3M, and 3K, for example.

The image forming apparatus 1000 may further include a first sheet cassette 31 and a second sheet cassette 32 under the optical writing unit 20, for example.

As shown in FIG. 1, the first sheet cassette 31 and second sheet cassette 32 may be provided in a vertical direction each other, for example.

The first sheet cassette 31 and second sheet cassette 32 may store a bundle of sheets as recording media.

A top sheet in the first sheet cassette 31 or second sheet cassette 32 is referred as recording sheet P. The recording sheet P may contact to a first feed roller 31*a* or a second feed roller 32*a*.

When the first feed roller 31*a*, driven by a driver (not shown), may rotate in a counter-clockwise direction in FIG. 1, the recording sheet P in the first sheet cassette 31 may be fed to a sheet feed route 33, which extends in a vertical direction in a right side of the image forming apparatus 1000.

Similarly, when the second feed roller 32*a*, driven by a driver (not shown), may rotate in a counter-clockwise direction in FIG. 1, the recording sheet P in the second sheet cassette 32 may be fed to the sheet feed route 33.

The sheet feed route 33 may be provided with a plurality of transport rollers 34 as shown in FIG. 1.

The plurality of transport rollers 34 may transport the recording sheet P in one direction in the sheet feed route 33 (e.g., from lower to upper direction in the sheet feed route 33).

The sheet feed route 33 may also be provided with a registration roller 35 at the end of the sheet feed route 33.

The registration roller 35 may receive the recording sheet P, fed by the transport roller 34, and then the registration roller 35 may stop its rotation temporarily.

Then, the registration roller 35 may feed the recording sheet P to a secondary transfer nip (to be described later) at a given timing.

As shown in FIG. 1, the image forming apparatus 1000 may further include a transfer unit 40 over the process units 1Y, 1C, 1M, and 1K, for example.

The transfer unit 40 may include an intermediate transfer belt 41, a belt-cleaning unit 42, a first bracket 43, a second bracket 44, primary transfer rollers 45Y, 45C, 45M, and 45K, a back-up roller 46, a drive roller 47, a support roller 48, and a tension roller 49, for example.

The intermediate transfer belt 41 may be extended by the primary transfer rollers 45Y, 45C, 45M, and 45K, back-up roller 46, drive roller 47, support roller 48, and tension roller 49.

The intermediate transfer belt 41 may travel in a counter-clockwise direction in FIG. 1 in an endless manner with a driving force of the drive roller 47.

The primary transfer rollers 45Y, 45C, 45M, and 45K, photoconductors 3Y, 3C, 3M, and 3K may form primary transfer nips respectively while sandwiching the intermediate transfer belt 41 therebetween.

The primary transfer rollers 45Y, 45C, 45M, and 45K may apply a primary transfer biasing voltage, supplied from a power source (not shown), to an inner face of the intermediate transfer belt 41.

The primary transfer biasing voltage may have an opposite polarity (e.g., positive polarity) with respect to toner polarity (e.g., negative polarity).

The intermediate transfer belt 41 traveling in an endless manner may receive the Y, C, M, and K toner image from the photoconductors 3Y, 3C, 3M, and 3K at the primary transfer nips for Y, C, M, and K toner image in a super-imposing and sequential manner, by which the Y, C, M, K toner image may be transferred to the intermediate transfer belt 41.

Accordingly, the intermediate transfer belt 41 may have a four-color (or full color) toner image thereon.

As shown in FIG. 1, a secondary transfer roller 50 provided over an outer face of the intermediate transfer belt 41 may form a secondary transfer nip with the back-up roller 46 while sandwiching the intermediate transfer belt 41 therebetween.

The registration roller 35 may feed the recording sheet P to the secondary transfer nip at a given timing, which is synchronized to a timing for forming the four-color toner image on the intermediate transfer belt 41.

The secondary transfer roller 50 and back-up roller 46 may generate a secondary transfer electric field therebetween.

The four-color toner image on the intermediate transfer belt 41 may be transferred to the recording sheet P at the secondary transfer nip with an effect of the secondary transfer electric field and nip pressure.

After transferring toner images at the secondary transfer nip to the recording sheet P, some toner particles may remain on the intermediate transfer belt 41.

The belt-cleaning unit 42 may remove such remaining toner particles from the intermediate transfer belt 41.

The belt-cleaning unit 42 may remove toner particles remaining on the intermediate transfer belt 41 by contacting a cleaning blade 42*a* on the outer face of the intermediate transfer belt 41, for example.

The first bracket 43 of the transfer unit 40 may pivot with a given rotational angle at an axis of the support roller 48 with an ON/OFF of solenoid (not shown).

In case of forming a monochrome image with the image forming apparatus 1000, the first bracket 43 may be rotated in a counter-clockwise direction in FIG. 1 for some degree by activating the solenoid.

With such rotating movement of the first bracket 43, the primary transfer rollers 45Y, 45C, and 45M may revolve in a counter-clockwise direction around the support roller 48.

With such process, the intermediate transfer belt 41 may be spaced apart from the photoconductors 3Y, 3C, and 3M.

Accordingly, a monochrome image can be formed on the recording sheet by driving the process unit 1K while stopping other process units 1Y, 1C, and 1M.

Such configuration may preferably reduce or suppress an aging of the process units 1Y, 1C, and 1M because the process units 1Y, 1C, and 1M may not be driven when a monochrome image forming is conducted.

As shown in FIG. 1, the image forming apparatus 1000 may include a fixing unit 60 over the secondary transfer nip, for example.

The fixing unit 60 may include a pressure roller 61 and a fixing belt unit 62, for example.

The fixing belt unit 62 may include a fixing belt 64, a heat roller 63, a tension roller 65, a drive roller 66, and a temperature sensor (not shown), for example.

The heat roller 63 may include a heat source such as halogen lamp, for example.

The fixing belt 64, extended by the heat roller 63, tension roller 65, and drive roller 66, may travel in a counter-clockwise direction in an endless manner. During such traveling movement of the fixing belt 64, the heat roller 63 may heat the fixing belt 64.

As shown in FIG. 1, the pressure roller 61 facing the heat roller 63 may contact an outer face of the heated fixing belt 64. Accordingly, the pressure roller 61 and the fixing belt 64 may form a fixing nip.

The temperature sensor (not shown) may be provided over an outer face of the fixing belt 64 with a given space and near the fixing nip so that the temperature sensor may detect a surface temperature of the fixing belt 64, which is just going into the fixing nip.

The temperature sensor transmits a detected temperature to a power source circuit (not shown) as a signal. Based on such signal, the power source circuit may control a power ON/OFF to the heat source in the heat roller 63, for example.

With such controlling, the surface temperature of fixing belt 64 may be maintained at a given level such as about 140 degree Celsius, for example.

The recording sheet P passed through the secondary transfer nip may then be transported to the fixing unit 60.

The fixing unit 60 may apply pressure and heat to the recording sheet P at the fixing nip to fix the four-color toner image on the recording sheet P.

After the fixing process, the recording sheet P may be ejected to an outside of the image forming apparatus 1000 with an ejection roller 67.

The image forming apparatus 1000 may further include a stack 68 on a top of the image forming apparatus 1000. The recording sheet P ejected by the ejection roller 67 may be stacked on the stack 68.

The image forming apparatus 1000 may further include toner cartridges 10Y, 100C, 100M, and 100K over the transfer unit 40. The toner cartridges 10Y, 100C, 100M, and 100K may store Y, C, M, and K toner, respectively.

The Y, C, M, and K toner may be supplied from the toner cartridges 100Y, 100C, 100M, and 100K to the developing unit 7Y, 7C, 7M, and 7K of the process units 1Y, 1C, 1M, and 1K, as required.

The toner cartridges 10Y, 100C, 100M, and 100K and the process units 1Y, 1C, 1M, and 1K may be separately detachable from the image forming apparatus 1000.

Hereinafter, a drive-force transmitting configuration in the image forming apparatus 1000 is explained with reference to FIGS. 5 and 6. The drive-force transmitting configuration may be attached to a housing structure of the image forming apparatus 1000, for example.

Figure 5:
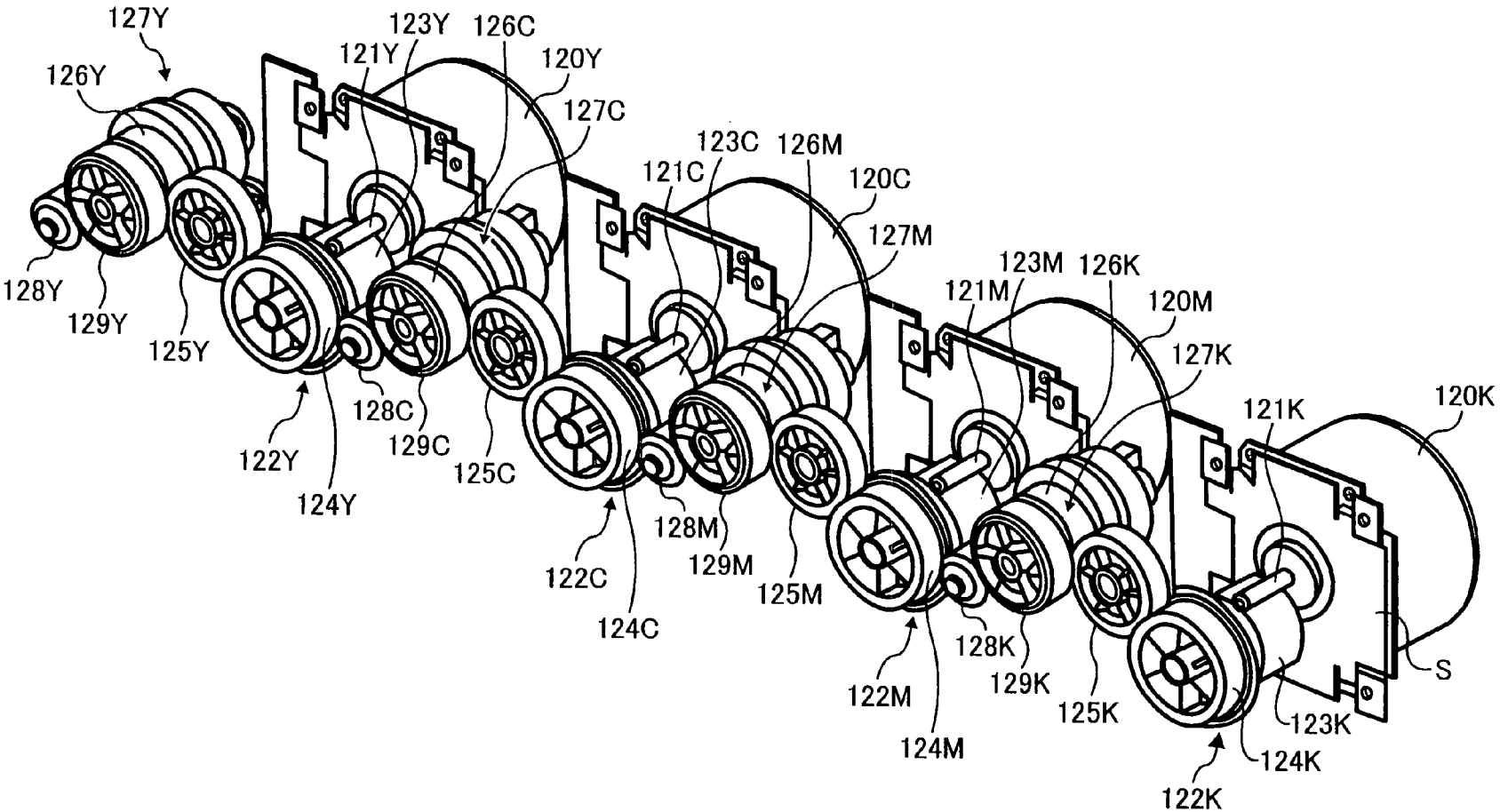
FIG. 5 is a perspective view of a drive-force transmitting configuration in an image forming apparatus of FIG. 1.

FIG. 5 is a perspective view of a drive-force transmitting configuration in the image forming apparatus 1000. FIG. 6 is a top view of the drive-force transmitting configuration of FIG. 5.

As shown in FIG. 5, the image forming apparatus 1000 may include a support plate S, to which process drive motors 120Y, 120C, 120M, and 120K may be attached.

The process drive motors 120Y, 120C, 120M, and 120K may drive the process unit 1Y, 1C, 1M, and 1K, respectively.

Each of the process drive motors 120Y, 120C, 120M, and 120K may include a shaft, to which drive gears 121Y, 121C, 121M, and 121K may be attached.

Under the shaft of the process drive motors 120Y, 120C, 120M, and 120K, developing gears 122Y, 122C, 122M, and 122K may be provided.

The developing gears 122Y, 122C, 122M, and 122K may drive the developing unit 7Y, 7M, 7C, and 7K.

The developing gears 122Y, 122C, 122M, and 122K may be engaged to a shaft (not shown), protruded from the support plate S, and may rotate on the shaft.

Each of the developing gears 122Y, 122C, 122M, and 122K may include first gears 123Y, 123C, 123M, and 123K, and second gears 124Y, 124C, 124M, and 124K, respectively.

The first gear 123Y and second gear 124Y may have a same shaft and rotate altogether. Other first gears 123C, 123M, and 123K, and second gears 124C, 124M, and 124K may also have a similar configuration.

Figure 6:
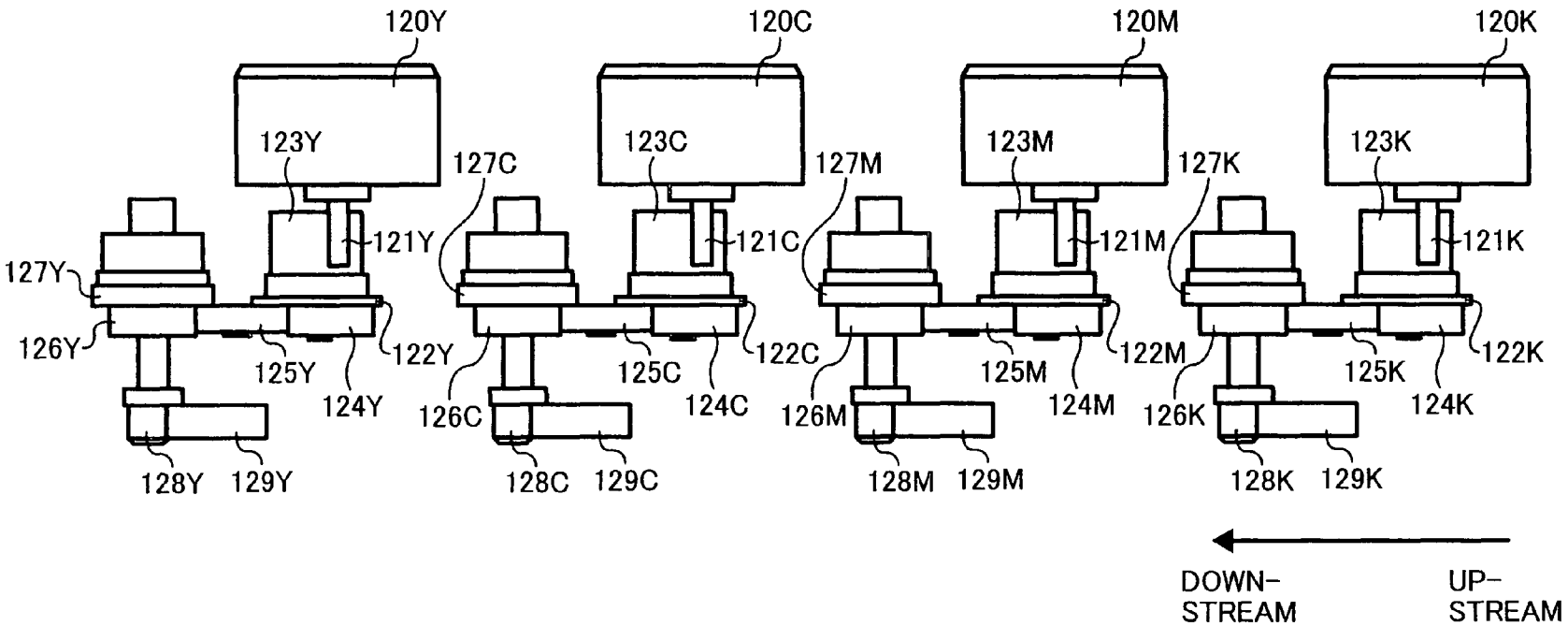
FIG. 6 is a top view of a drive-force transmitting configuration of FIG. 5.

As shown in FIGS. 5 and 6, the first gears 123Y, 123C, 123M, and 123K may be provided between the process drive motors 120Y, 120C, 120M, and 120K, and the second gears 124Y, 124C, 124M, and 124K, respectively.

The first gears 123Y, 123M, 123C, and 123K may be meshed to the drive gears 121Y, 121C, 121M, and 121K of the process drive motors 120Y, 120C, 120M, and 120K, respectively.

Accordingly, the developing gears 122Y, 122M, 122C, and 122K may be rotatable by a rotation of the process drive motors 120Y, 120C, 120M, and 120K, respectively.

The process drive motors 120Y, 120C, 120M, and 120K may include a DC (direct current) brushless motor such as DC (direct current) servomotor, for example.

The drive gears 121Y, 121C, 121M, and 121K, and photoconductor gears 133Y, 133C, 133M, and 133K (see FIG. 8) have a given speed reduction ratio such as 1:20, for example.

Figure 8:
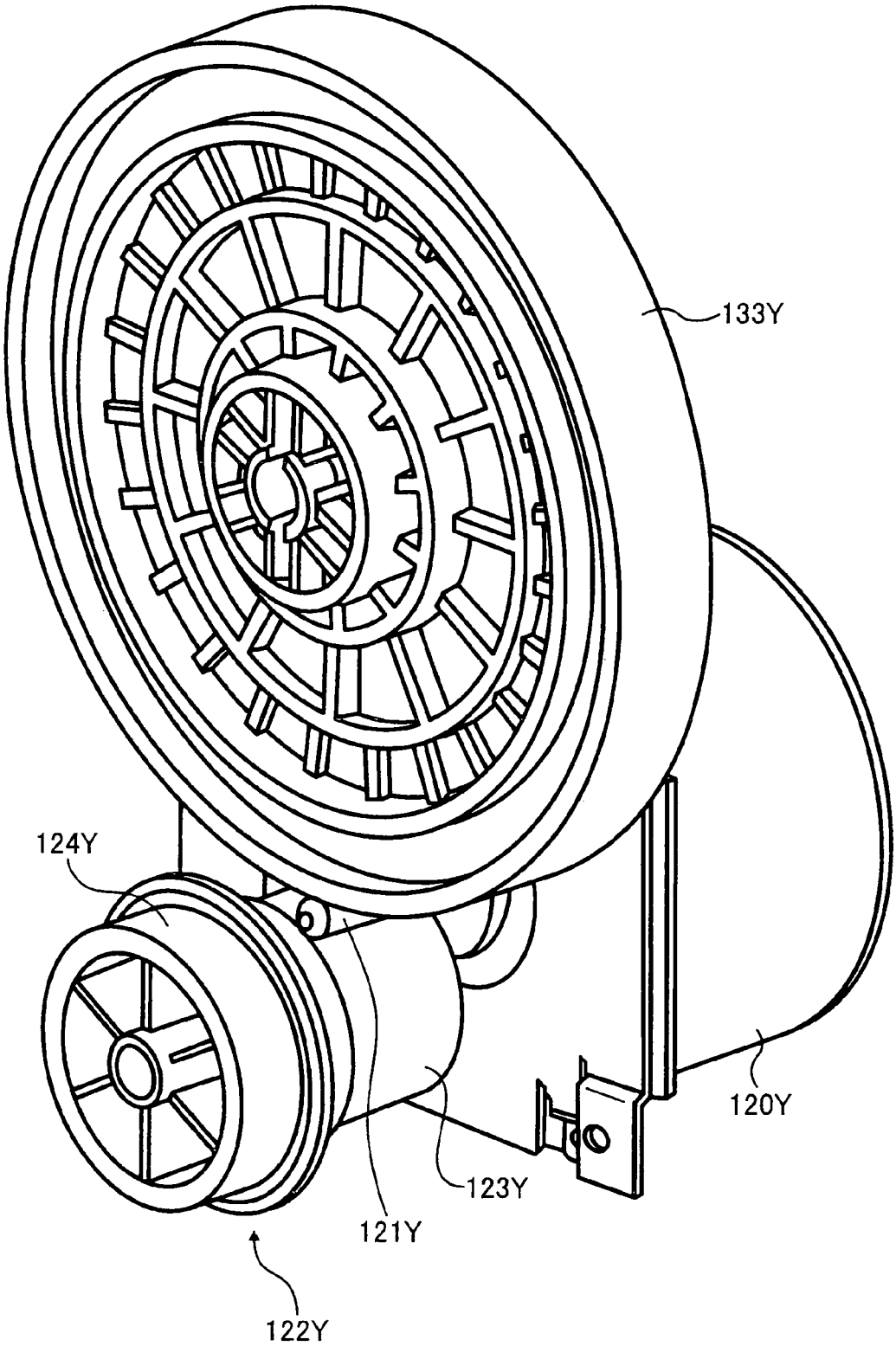
FIG. 8 is a perspective view of a photoconductor gear and its surrounding configuration.

As shown in FIG. 8, a number of speed-reduction stage from the drive gear 121 to the photoconductor gear 133 may be set to one stage in an example embodiment.

In general, the smaller the number of parts or components, the smaller the manufacturing cost of an apparatus.

Furthermore, the smaller the number of gears used for speed-reduction, the smaller the effect of meshing or eccentricity error of gears, or drive-force transmitting error.

Accordingly, two gears (e.g., drive gear 121 and photoconductor gear 133) may be used for reducing a speed with one stage.

Such one-stage speed reduction may result into a relatively greater speed reduction ratio such as 1:20, by which a diameter of the photoconductor gear 133 may become greater than the photoconductor 3.

By using the photoconductor gear 133 having a greater diameter, a pitch deviation on a surface of the photoconductor 3 corresponding to one tooth meshing of gear may become smaller, by which an image degradation caused by uneven printing concentration in sub-scanning direction may be reduced.

A speed reduction ratio may be set based on a relationship of a target speed of the photoconductor 3 and a physical property of the process drive motor 120. Specifically, a speed range may be determined to realize higher efficiency of motor such as reducing of motor energy loss and higher rotational precision of motor such as reducing uneven rotation of motor.

As shown in FIGS. 5 and 6, first linking gears 125Y, 125C, 125M, and 125K are provided at the left side of the developing gears 122Y, 122C, 122M, and 122K.

The first linking gears 125Y, 125C, 125M, and 125K may be rotatable on a shaft (not shown), provided on the support plate S.

As shown in FIGS. 5 and 6, the first linking gears 125Y, 125C, 125M, and 125K may be meshed to the second gears 124Y, 124C, 124M, and 124K of the developing gears 122Y, 122C, 122M, and 122K, respectively.

Accordingly, the first linking gears 125Y, 125C, 125M, and 125K may be rotatable with a rotation of the developing gears 122Y, 122C, 122M, and 122K, respectively.

As shown in FIG. 6, the first linking gears 125Y, 125C, 125M, and 125K may be meshed to the second gears 124Y, 124C, 124M, and 124K, respectively, at an up-stream side of drive-force transmitting direction.

As also shown in FIG. 6, the first linking gears 125Y, 125C, 125M, and 125K may also be meshed to clutch input gears 126Y, 126C, 126M, and 126K, respectively, at a down-stream side the drive-force transmitting direction.

As shown in FIGS. 5 and 6, the clutch input gears 126Y, 126C, 126M, and 126K may be supported by developing clutch 127Y, 127C, 127M, and 127K, respectively.

Each of the developing clutches 127Y, 127C, 127M, and 127K may be controlled by a controller of the image forming apparatus 1000.

Specifically, the controller may control power supply to the developing clutches 127Y, 127C, 127M, and 127K by conducing power ON/OFF to the developing clutches 127Y, 127C, 127M, and 127K.

Under a control by the controller, a clutch shaft of the developing clutches 127Y, 127C, 127M, and 127K may be engaged to the clutch input gears 126Y, 126C, 126M, and 126K to rotate with the clutch input gears 126Y, 126C, 126M, and 126K.

Or under a control by the controller, the clutch shaft of the developing clutches 127Y, 127C, 127M, and 127K may be disengaged from the clutch input gears 126Y, 126C, 126M, and 126K to rotate only the clutch input gears 126Y, 126C, 126M, and 126K, in which the clutch input gears 126Y, 126C, 126M, and 126K may be idling.

As shown in FIG. 6, clutch output gears 128Y, 128C, 128M, and 128K may be attached to an end of the clutch shaft of the developing clutches 127Y, 127C, 127M, and 127K, respectively.

When a power is supplied to the developing clutches 127Y, 127C, 127M, and 127K, the clutch shaft of the developing clutches 127Y, 127C, 127M, and 127K may be engaged to the clutch input gears 126Y, 126C, 126M, and 126K.

Then, a rotation of the clutch input gears 126Y, 126C, 126M, and 126K may be transmitted to the clutch shaft of the developing clutches 127Y, 127C, 127M, and 127K, by which the clutch output gears 128Y, 128C, 128M, and 128K may be rotated.

On one hand, when a power supply to the developing clutches 127Y, 127C, 127M, and 127K is stopped, the clutch shaft of the developing clutches 127Y, 127C, 127M, and 127K may be disengaged from the clutch input gears 126Y, 126C, 126M, and 126K, by which only the clutch input gears 126Y, 126C, 126M, and 126K may be idling without rotating the clutch shaft of the developing clutches 127Y, 127C, 127M, and 127K.

Accordingly, the rotation of the clutch input gears 126Y, 126C, 126M, and 126K may not be transmitted to the clutch output gears 128Y, 128C, 128M, and 128K, respectively.

Therefore, a rotation of the clutch output gears 128Y, 128C, 128M, and 128K may be stopped because the process drive motors 120Y, 120C, 120M, and 120K may be idling.

As shown in FIG. 6, second linking gears 129Y, 129C, 129M, and 129K may be meshed at the right side of the clutch output gears 128Y, 128C, 128M, and 128K, respectively.

Accordingly, the second linking gears 129Y, 129C, 129M, and 129K may be rotatable with the clutch output gears 128Y, 128C, 128M, and 128K, respectively.

The above-described drive-force transmitting configuration in the image forming apparatus 1000 may transmit a drive force as below.

Specifically, a drive force may be transmitted with a sequential order beginning from the process drive motor 120, drive gear 121, first gear 123 and second gear 124 of developing gear 122, first linking gear 125, clutch input gear 126, clutch output gear 128, and to second linking gear 129.

Figure 7:
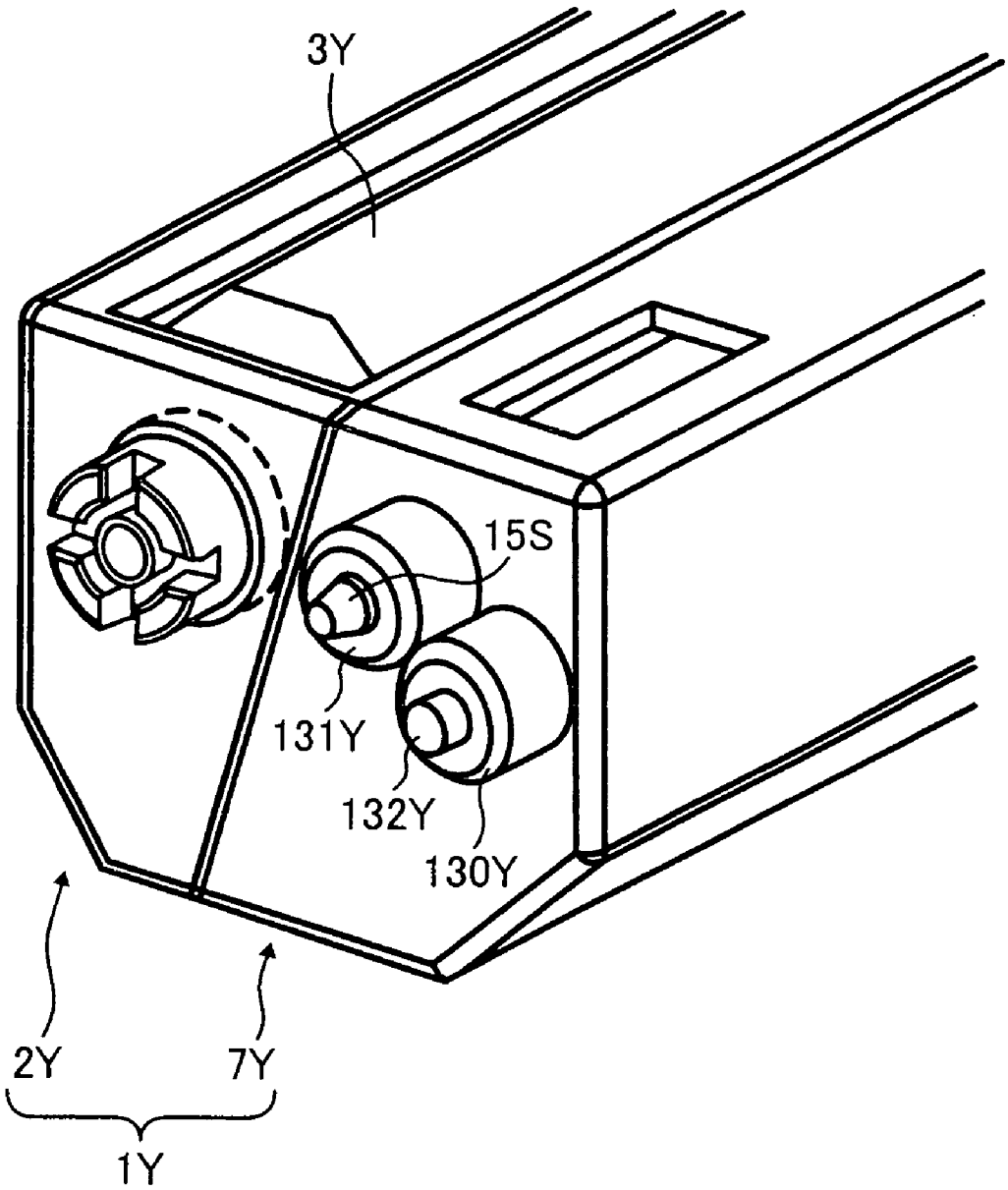
FIG. 7 is a partial perspective view of one end of a process unit of FIG. 2.

FIG. 7 is a partial perspective view of the process unit 1Y.

The developing sleeve 15Y in the developing unit 7Y may have a shaft 15S, which protrudes from one end face of a casing of the developing unit 7Y as shown in FIG. 7.

As shown in FIG. 7, the shaft 15S may be attached with a first sleeve gear 131Y.

As also shown in FIG. 7, an attachment shaft 132Y may be protruded from the one end face of a casing of the developing unit 7Y.

The attachment shaft 132Y may be attached with a third linking gear 130Y rotatable with the attachment shaft 132Y. The third linking gear 130Y may mesh with the first sleeve gear 131Y as shown in FIG. 7.

When the process unit 1Y is set in the image forming apparatus 1000, the third linking gear 130Y meshing with the first sleeve gear 131Y may mesh with the second linking gear 129Y shown in FIGS. 5 and 6.

Accordingly, a rotation of the second linking gear 129Y may be sequentially transmitted to the third linking gear 130Y, and then to the first sleeve gear 131Y, by which the developing sleeve 15Y may be rotated.

Similarly, a rotation may be transmitted to a developing sleeve of other process units 1C, 1M, and 1K in a similar manner.

FIG. 7 shows one end of the process unit 1Y. At the other end of the process unit 1Y, the shaft 15S of the developing sleeve 15Y may also be protruded from the casing, and the protruded portion of the shaft 15S may be attached with a second sleeve gear (not shown).

Although not shown in FIG. 7, each of the first transport screw 8Y and second transport screw 10Y (see in FIG. 2) may have a shaft, which protrudes from the other end of the casing of the process unit 1Y.

The protruded portion of the shafts (not shown) of the first transport screw 8Y and second transport screw 10Y may be respectively attached with a first screw gear, and a second screw gear (not shown).

The second screw gear may mesh with the second sleeve gear (not shown), and also mesh with the first screw gear.

When the developing sleeve 15Y is rotated by a rotation of the first sleeve gear 131Y, the second sleeve gear at the other end of the process unit 1Y may also be rotated.

With a rotation of the second sleeve gear, the second screw gear is rotated, and then a driving force, transmitted from the second screw gear, may rotate the second transport screw 11Y.

Furthermore, the first screw gear meshed to the second screw gear may transmit a driving force to the first transport screw 8Y, by which the first transport screw 8Y may rotate.

A similar configuration may be applied to other process units 1C, 1M, and 1K.

As above described, each of the process units 1Y, 1C, 1M, and 1K may include a group of gears, which may be used for a developing process such as drive gear 121, developing gear 122, first linking gear 125, clutch input gear 126, clutch output gear 128, second linking gear 129, third linking gear 130, first sleeve gear 131Y, second sleeve gear, first screw gear, and second screw gear, for example.

FIG. 8 is a perspective view of the photoconductor gear 133Y and its surrounding configuration.

As shown in FIG. 8, the drive gear 121Y may mesh the first gear 123Y of developing gear 122Y, and the photoconductor gear 133Y.

With such configuration, the photoconductor gear 133Y, used as drive-force transmitting member, may be rotatable by the drive-force transmitting configuration of the image forming apparatus 100.

In an example embodiment, a diameter of the photoconductor gear 133Y may be set greater than a diameter of the photoconductor 3.

When the process drive motor 120Y rotates, a rotation of the process drive motor 120Y may be transmitted to the photoconductor gear 133Y via the drive gear 121 with one-stage speed reduction, by which the photoconductor 3 may rotate.

A similar configuration may be applied to other process units 1C, 1M, and 1K in the image forming apparatus 1000.

A shaft of the photoconductor 3 in the process unit 1 may be connected to the photoconductor gear 133 with a coupling (not shown) attached to one end of the shaft of photoconductor 3.

The photoconductor gear 133 may be supported by an internal structure of the image forming apparatus 1000, for example.

In the above explanation, one motor (e.g., process drive motor 120) may be used for driving gears. However, a plurality of motors may be used for driving gears. For example, a motor for driving the photoconductor gear 133, and a motor for driving the drive gear 121 may be a different motor for each of the process unit 1Y, 1C, 1M, and 1K.

Hereinafter, a configuration for controlling an image forming in the image forming apparatus 1000 is explained.

Figure 9:
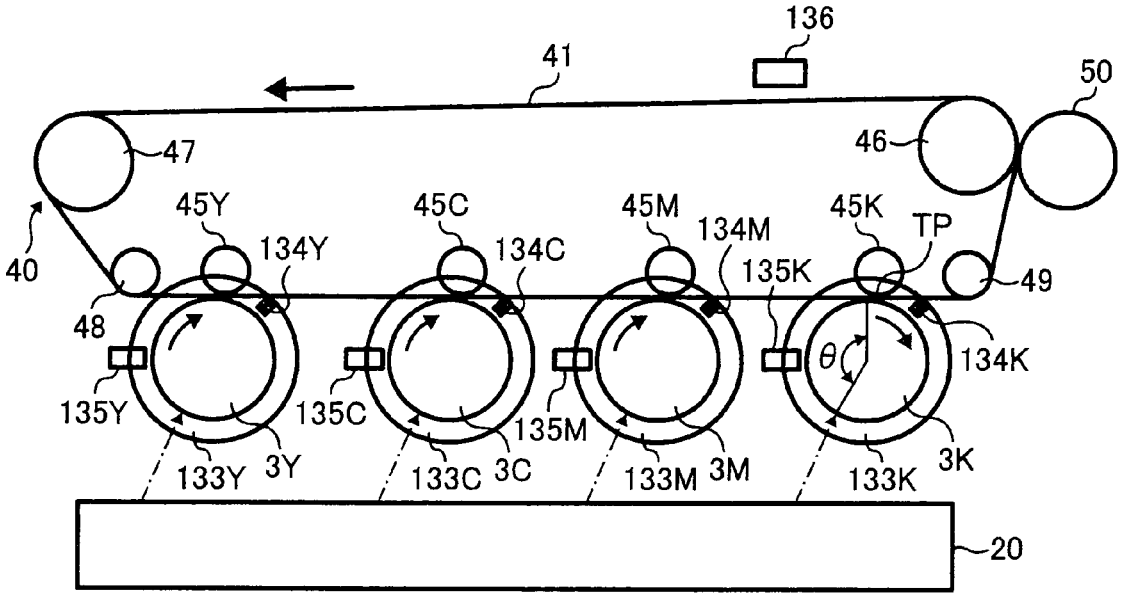
FIG. 9 is a schematic configuration of photoconductors, a transfer unit, and an optical writing unit in an image forming apparatus of FIG. 1.

FIG. 9 is a schematic configuration of the photoconductors 3Y, 3C, 3M, and 3K, transfer unit 40, and optical writing unit 20 in the image forming apparatus 1000.

As shown in FIG. 9, the photoconductor gears 133Y, 133C, 133M, and 133K may have respective markings 134Y, 134C, 134M, and 134K thereon at a given position.

A rotation of the photoconductor gears 133Y, 133C, 133M, and 133K may be transmitted to the respective photoconductors 3Y, 3C, 3M, and 3K.

As also shown in FIG. 9, the image forming apparatus 1000 may further include position sensors 135Y, 135C, 135M, and 135K. The position sensor 135 may include a photosensor, for example.

The position sensors 135Y, 135C, 135M, and 135K may detect the markings 134Y, 134C, 134M, and 134K at a given timing, respectively.

Specifically, the position sensors 135Y, 135C, 135M, and 135K may detect the markings 134Y, 134C, 134M, and 134K per one revolution of the photoconductor gears 133Y, 133C, 133M, and 133K, for example.

With such configuration, a rotational speed of the photoconductors 3Y, 3C, 3M, and 3K per one revolution may be detected.

In other words, a timing when the photoconductors 3Y, 3C, 3M, and 3K come to a given rotational angle may be detected with the position sensors 135Y, 135C, 135M, and 135K and markings 134Y, 134C, 134M, and 134K.

As shown in FIG. 9, an optical sensor unit 136 may be provided over the transfer unit 40, for example.

Figure 10:
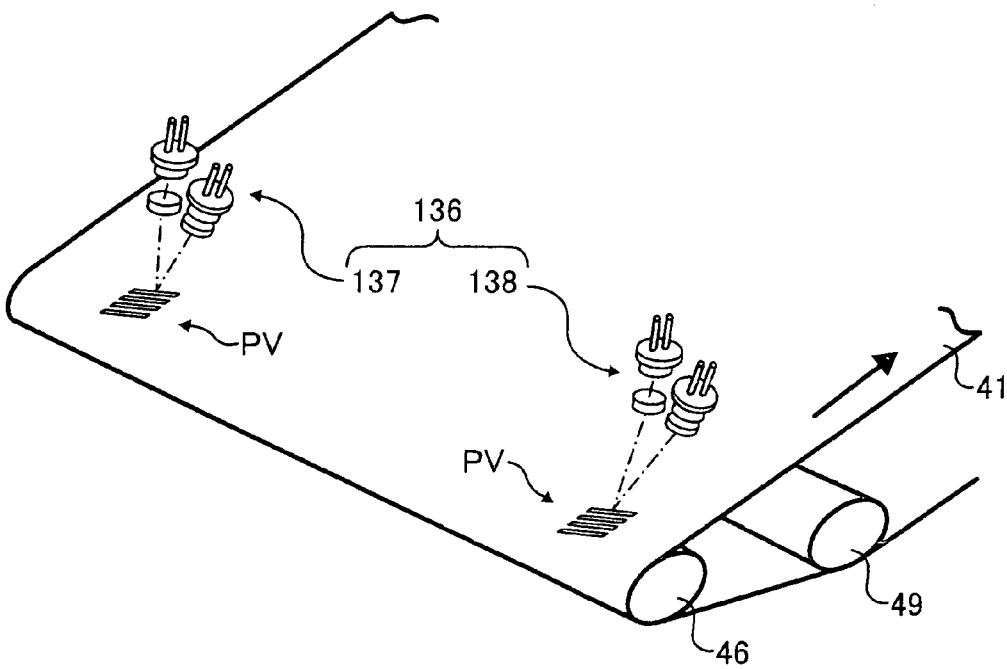
FIG. 10 is a perspective view of an intermediate transfer belt with an optical sensor unit.

As shown in FIG. 10, the optical sensor unit 136 may include two optical sensors 137 and 138 over the transfer unit 40, for example.

Such two optical sensors 137 and 138 may be spaced apart with each other in a width direction of the intermediate transfer belt 41, and the two optical sensors 137 and 138 may be provided over the transfer unit 40 with a given space as shown in FIG. 10.

The optical sensors 137 and 138 may include a reflection type photosensor (not shown), for example.

FIG. 10 is a perspective view of the intermediate transfer belt 41 and optical sensor unit 136 having the optical sensors 137 and 138.

A controller of the image forming apparatus 1000 may conduct a timing adjustment control at a given timing. Such timing may include when a power-supply switch (not shown) is pressed to ON, and when a given time period has lapsed, for example.

As shown in FIG. 10, the timing adjustment control may be conducted by forming a detection image PV on a first and second lateral side of the intermediate transfer belt 41.

The detection image PV may be used for detecting positional deviation of toner images formed on the intermediate transfer belt 41.

As shown in FIG. 10, the first and second lateral side may be opposite sides in a width direction of the intermediate transfer belt 41.

The detection image PV for detecting positional deviation of toner images may be formed with a plurality of toner images, which will be described later.

The optical sensor unit 136, provided over the intermediate transfer belt 41, may include the optical sensors 137 and 138. The optical sensors 137 may be refereed as first optical sensor 137, and the optical sensors 138 may be refereed as second optical sensor 138, hereinafter.

The first optical sensor 137 may include a light source and a light receiver. A light beam emitted from the light source passes through a condenser lens, and reflects on a surface of the intermediate transfer belt 41. The light receiver receives the reflected light beam.

Based on a light intensity of the received light beam, the first optical sensor 137 may output a voltage signal.

When the toner images in the detection image PV on the first lateral side of the intermediate transfer belt 41 passes through an area under the first optical sensor 137, a light intensity received by the light receiver of the first optical sensor 137 may change compared to before detecting the toner images in the detection image PV.

Then, the first optical sensor 137 may output a voltage signal based on a light intensity received by the light receiver.

Similarly, the second optical sensor 138 may detect toner images in another detection image PV formed on the second lateral side of the intermediate transfer belt 41.

As such, the first and second optical sensors 137 and 138 may detect toner images in the detection image PV formed on the first and second lateral side of the intermediate transfer belt 41.

The light source may include an LED (light emitting diode) or the like, which can generate a light beam having a preferable level of light intensity for detecting toner image.

The light receiver may include a CCD (charge coupled device), which has a number of light receiving elements arranged in rows, for example.

With such process, toner images in a detection image PV formed on each lateral side of the intermediate transfer belt 41 may be detected.

Based on a detection result, a position of each toner image in a main scanning direction (i.e., scanning direction by a light beam), a position of each toner image in a sub-scanning direction (i.e., belt moving direction), multiplication constant error in a main scanning direction, a skew in a main scanning direction may be adjusted, for example.

Figure 11:
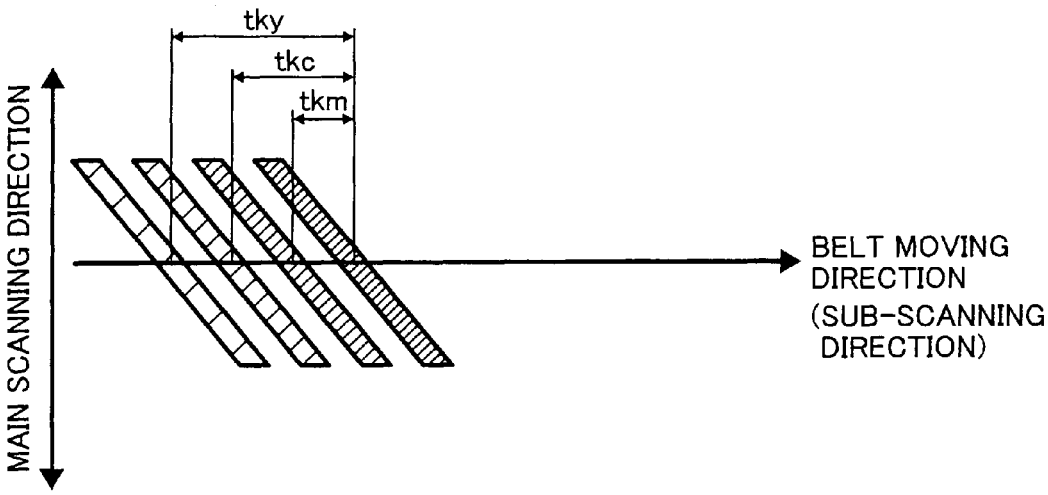
FIG. 11 is a schematic view of an image pattern for detecting positional deviation of images.

As shown in FIG. 11, the detection image PV may include a group of line image patterns, in which toner images of Y, C, M, and K may be formed on the intermediate transfer belt 41 by inclining each line image approximately 45 degrees from the main scanning direction and setting a given pitch between each of the line images in a sub-scanning direction (or belt moving direction).

Although the line image patterns of Y, C, M, and K are slanted from the main scanning direction in FIG. 11, the line image patterns of Y, C, M, and K may be formed on the intermediate transfer belt 41 without slanting from the main scanning direction. For example, line image patterns of Y, C, M, and K, which are parallel to the main scanning direction, may be formed on the on the intermediate transfer belt 41, for example.

In an example embodiment, a detection time difference between K toner image and each of other toner images (i.e., Y, C, M toner image) in one detection image PV may be detected, for example.

In FIG. 11, line images of Y, C, M, and K are lined from left to right, for example.

The K toner image may be used as reference color image, and a detection time difference between the K toner image and each of Y, C, M toner images are referred as "tyk, tck, and tmk" in FIG. 11.

A difference between a measured value and a theoretical value of "tyk, tck, and tmk" may be compared to calculate a deviation amount of each toner image in a sub-scanning direction.

The polygon mirror 21 may have regular polygonal shape such as hexagonal shape, for example. Accordingly, the polygon mirror 21 has a plurality mirror faces having a similar shape.

If the polygon mirror 21 may have a hexagonal shape, the polygon mirror 21 has six mirror faces. If the polygon mirror 21 rotates for one revolution, optical writing process may be conducted for six times (or six scanning lines) in a main scanning direction of an image carrier (e.g., photoconductor), which rotates during an optical writing process.

Accordingly, a pitch of scanning line may correspond to a moving distance of image carrier, which rotationally moves during a time period when a light beam coming from one mirror face of the polygon mirror 21 scans the image carrier.

Based on the calculated deviation amount of the toner images, an optical-writing starting timing to the photoconductor 3Y, 3C, 3M, and 3K may be adjusted for each scanning line, corresponding to each mirror face of the polygon mirror 21 of the optical writing unit 20.

With such adjustment, a superimposing-deviation of toner images in the sub-scanning direction may be reduced.

In the above-described timing adjustment control, an image-to-image displacement may be detected and adjusted (or controlled), wherein the image-to-image displacement may mean a situation that one color image and another color image may be incorrectly superimposed each other on the intermediate transfer belt 41. Accordingly, instead the above-described timing adjustment control, an image-to-image displacement control may be used in this disclosure, as required.

Furthermore, the controller of the image forming apparatus 1000 may also conduct a speed-deviation checking for each of the photoconductors 3Y, 3C, 3M, and 3K.

Specifically, the controller may conduct a speed-deviation checking to detect a speed deviation of each of the photoconductors 3Y, 3C, 3M, and 3K per one revolution.

In the speed-deviation checking, a speed-deviation checking image for each of Y, C, M, and K color may be formed on a surface of the intermediate transfer belt 41.

Hereinafter, a speed-deviation checking image of K color is explained as a representative of Y, C, M and K color.

Figure 12:
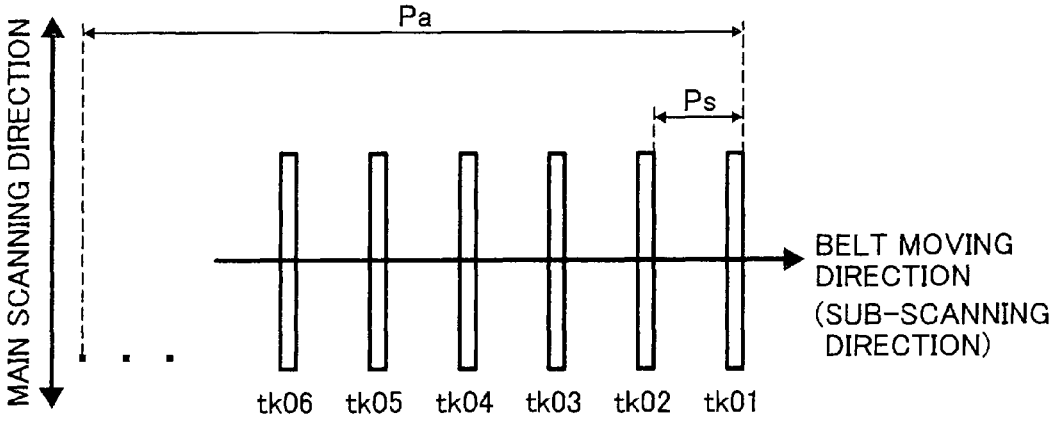
FIG. 12 is a schematic view of a speed-deviation checking image to be used for a phase adjustment of photoconductors.

As shown in FIG. 12, a plurality of toner images may be formed on the intermediate transfer belt 41 in a belt moving direction (or sub-scanning direction) with a given pitch.

In FIG. 12, the plurality of toner images for K are refereed as "tk01, tk02, tk03, tk04, tk05, tk06, . . . " in FIG. 12, for example.

Although the toner images "tk01, tk02, tk03, tk04, tk05, and tk06, . . . " may be formed with a given theoretical pitch, an actual pitch of toner images "tk01, tk02, tk03, tk04, tk05, and tk06, . . . " may be deviated from the given theoretical pitch due to a speed deviation of the photoconductor 3K.

Based on a signal, transmitted from the first and second optical sensor 137 and 138, a CPU 146 (see FIG. 13) may convert a distance value, corresponding to a pitch-deviated length, to a time difference value using an internal clock of the CPU 146.

Hereinafter, such time difference value may be referred as "time-pitch error," as required.

In the image forming apparatus 1000, a speed-deviation checking may be conducted by forming a speed-deviation checking image of Y color and a speed-deviation checking image of K color as one set.

Similarly, a speed-deviation checking image of C color and a speed-deviation checking image of K color may be formed as one set.

Similarly, a speed-deviation checking image of M color and a speed-deviation checking image of K color may be formed as one set.

Specifically, in case of one set of Y and K color, the speed-deviation checking image of Y color may be formed on a first lateral side of the intermediate transfer belt 41, and the speed-deviation checking image of K color may be formed on a second lateral side of the intermediate transfer belt 41, for example.

Then, the speed-deviation checking image of Y color may be detected with the first optical sensor 137, and the speed-deviation checking image of K color may be detected with the second optical sensor 138, wherein the first optical sensor 137 and second optical sensor 138 may detect one set of speed-deviation checking images formed on the intermediate transfer belt 41 in a substantially concurrent manner, for example.

A similar process may be applied to one set of the speed-deviation images C and K, and one set of speed-deviation images M and K, wherein the first optical sensor 137 and second optical sensor 138 may detect one set of speed-deviation checking images formed on the intermediate transfer belt 41 in a substantially concurrent manner.

In other words, the image forming apparatus 1000 may conduct three processes for the speed-deviation checking: a process of forming speed-deviation checking images for Y and K color, and detecting such images with the optical sensor unit 136; a process of forming speed-deviation checking images for C and K color, and detecting such images with the optical sensor unit 136; and a process of forming speed-deviation checking images for M and K color, and detecting such images with the optical sensor unit 136.

The speed-deviation checking process will be described later.

As shown in FIG. 1, the intermediate transfer belt 41 may pass through the secondary transfer nip, defined by the secondary transfer roller 50 and the intermediate transfer belt 41, before the intermediate transfer belt 41 comes to a position facing the optical sensor unit 136.

Accordingly, the above-mentioned detection image PV or speed-deviation checking image, formed on the intermediate transfer belt 41, may contact the secondary transfer roller 50 at the secondary transfer nip before the intermediate transfer belt 41 comes to the position facing the optical sensor unit 136.

If the secondary transfer roller 50 may contact the intermediate transfer belt 41 at the secondary transfer nip, the above-mentioned detection image PV or speed-deviation checking image may be transferred to a surface of the secondary transfer roller 50 from the intermediate transfer belt 41.

Accordingly, in an example embodiment, a roller contact/discontact unit (not shown) may be activated to discontact the secondary transfer roller 50 from the intermediate transfer belt 41 before the above-mentioned timing adjustment control or speed-deviation checking is conducted in the image forming apparatus 1000.

With such configuration, the above-mentioned detection image PV or speed-deviation checking image may not be transferred to the secondary transfer roller 50.

Hereinafter, a circuit configuration for controller controlling the image forming apparatus 1000 is explained with FIG. 13.

Figure 13:
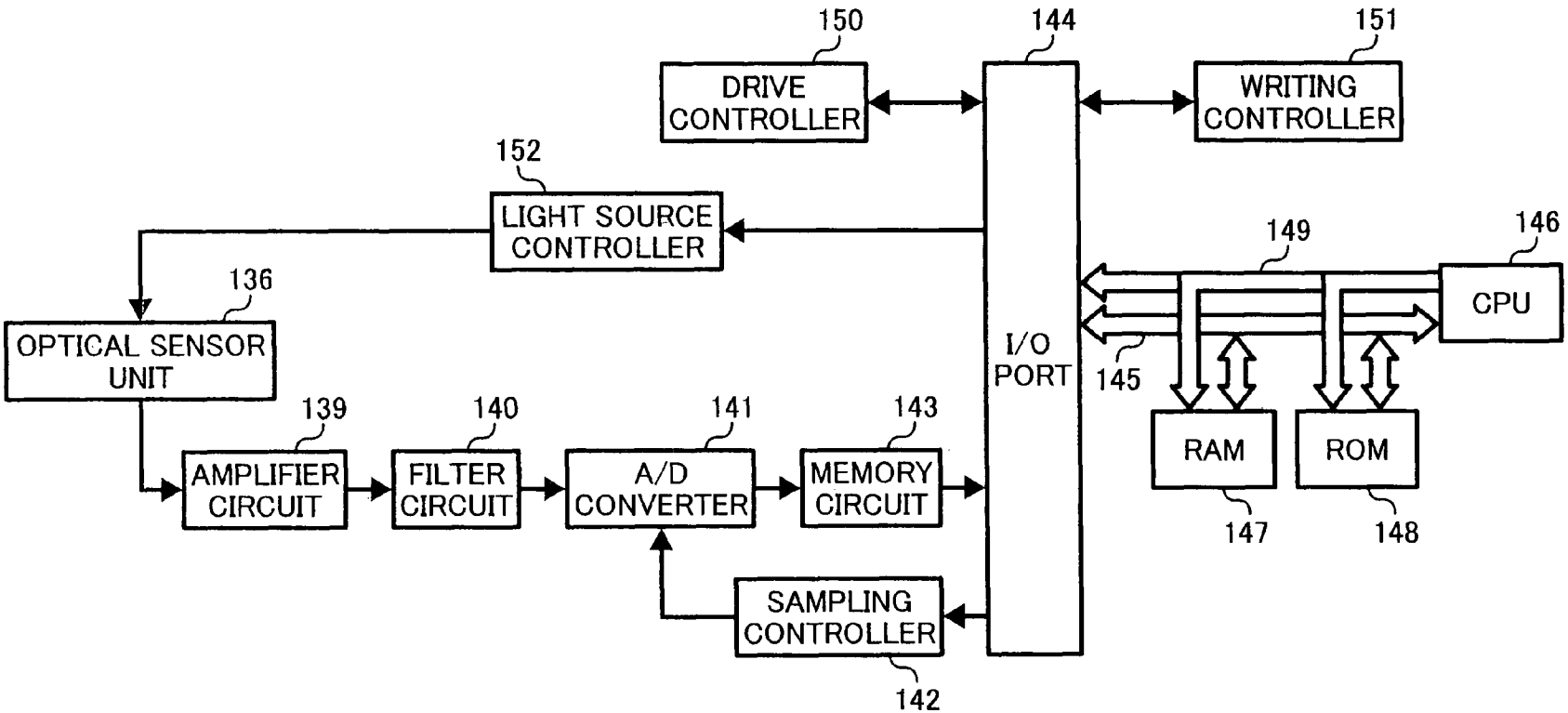
FIG. 13 is a block diagram explaining a circuit configuration of a controller of an image forming apparatus of FIG. 1.

FIG. 13 is a block diagram of a circuit configuration of the controller of the image forming apparatus 1000.

The circuit configuration may include the optical sensor unit 136, an amplifier circuit 139, a filter circuit 140, an A/D (analog/digital) converter 141, a sampling controller 142, a memory circuit 143, an I/O (input/output) port 144, a data bus 145, a CPU (central processing unit) 146, a RAM (random access memory) 147, a ROM (read only memory) 148, an address bus 149, a drive controller 150, a writing controller 151, and a light source controller 152.

When the timing adjustment control or speed-deviation checking is conducted, the optical sensor unit 136 may transmit a signal to the amplifier circuit 139, and the amplifier circuit 139 may amplify and transmit the signal to the filter circuit 140.

The filter circuit 140 may select a line detection signal, and transmit the selected signal to the A/D converter 141, at which analog data may be converted to digital data.

Then, the sampling controller 142 may control data sampling, and the sampled data may be stored in the memory circuit 143 by FIFO (first-in first-out) manner.

When a detection of the detection image PV or speed-deviation checking image is completed, the data stored in the memory circuit 143 may be loaded to the CPU 146 and RAM 147 via the I/O port 144 and data bus 145.

Then, the CPU 146 may conduct arithmetic processing to compute deviation amounts such as positional deviation of each toner image, skew deviation, phase deviation of each image carriers (e.g., photoconductor), for example.

The CPU 146 may also conduct arithmetic processing for computing multiplication rate for each toner image in main scanning direction and sub-scanning direction, for example.

The CPU 146 may store data to the drive controller 150 or writing controller 151 such computed data for deviation amount.

The drive controller 150 or writing controller 151 may conduct a correction operation with such data.

Such correction operation may include skew correction of each toner image, image position correction in a main scanning direction, image position correction in a sub-scanning direction, and multiplication rate correction, for example.

The drive controller 150 may control the process drive motors 120Y, 120C, 120M, and 120K, which drives the photoconductors 3Y, 3M, 3M, and 3K, respectively.

The writing controller 151 may control the optical writing unit 20.

The writing controller 151 may adjust a writing-starting position in a main scanning direction and sub-scanning direction for the photoconductors 3Y, 3M, 3M, and 3K based on data transmitted from the CPU 146.

The writing controller 151 may include a device such as clock generator using VCO (voltage controlled oscillator) to set output frequency precisely. In the image forming apparatus 1000, an output of the clock generator may be used as image clock.

The drive controller 150 may generate drive-control data to control the process drive motors 120Y, 120C, 120M, and 120K, based on data transmitted from the CPU 146, to adjust a phase of each of the photoconductors 3Y, 3C, 3M, and 3K per one revolution.

In the image forming apparatus 1000, the light source controller 152 may control light intensity of the light source of the optical sensor unit 136. With such controlling, the light intensity of the light source of the optical sensor unit 136 may be maintained at a preferable level.

The ROM 148, connected to the data bus 145, may store programs such as algorithm for computing the above-mentioned deviation amount, a program for conducting printing job, and a program for conducting a timing adjustment control, speed-deviation checking, phase adjustment control, for example.

The CPU 146 may designate ROM address, RAM address, and input/output units via the address bus 149.

As shown in FIG. 12, the speed-deviation checking image may include a plurality of toner images having a same color, which are formed on the intermediate transfer belt 41 with a given pitch in a sub-scanning direction (or belt moving direction).

A pitch PS, shown in FIG. 12, for toner images in one speed-deviation checking image may preferably set to a smaller value. However, the pitch PS may not be set too-small value because of width limitation on image forming and computing-time limitation, for example.

Furthermore, a length Pa of the speed-deviation checking image in a sub-scanning direction (or belt moving direction) may be set to a length, which is obtained by multiplying the circumference length of the photoconductor 3 with an integral number (e.g., one, two, three).

When to set the length Pa, cyclical deviations not related to the photoconductor 3 may need to be considered.

Such other cyclical deviations may occur when a speed-deviation checking image is formed on the intermediate transfer belt 41 and when conducting the speed-deviation checking.

Such other cyclical deviations may include various types of frequency components such as linear velocity deviation of the drive roller 47 per one revolution for driving the intermediate transfer belt 41, tooth pitch deviation or eccentricity of gears, which drives the intermediate transfer belt 41 or transmits a driving force to the intermediate transfer belt 41, meandering of intermediate transfer belt 41, or thickness deviation distribution of the intermediate transfer belt 41 in a circumferential direction, for example.

In general, when the speed-deviation image is detected, a detected value may include such cyclical deviations components, which may not be related to the photoconductor 3.

Therefore, a speed deviation component of the photoconductor 3 per one revolution may need to be detected by extracting such cyclical deviation components, which may not be related to the photoconductor 3.

For example, in addition to a speed deviation component of the photoconductor 3 per one revolution, assume that a speed deviation component of the drive roller 47 per one revolution may be included in a time-pitch error when conducting a speed-deviation checking image.

In such a case, a speed deviation component of the drive roller 47 may need to be reduced or suppressed to set the length Pa for the speed-deviation checking image at a preferable level.

For example, the photoconductor 3 may have a diameter of 40 mm, and the drive roller 47 may have a diameter of 30 mm.

In such condition, one cycle of photoconductor 3 and one cycle of drive roller 47 may become 125.7 mm, and 94.2 mm, respectively. The one cycle can be calculated by a formula of "$2\pi r$," wherein "r" is a radius of circle.

A common multiple of such two cycles may be used to set a length Pa preferably for speed-deviation checking.

For example, the common multiple of 125.7 mm and 94.2 mm may become 377 mm, by which the length Pa may be set to 377 mm.

Based on such length Pa, the pitch PS of each toner image in the speed-deviation checking image may be set.

With such setting, a computation of maximum amplitude or phase value of speed-deviation image of the photoconductor 3 per one revolution may be conducted with a higher precision by reducing an effect of cyclical deviation component of drive roller 47.

Such computation of maximum amplitude or phase value may be possible because a computing term of the cyclical deviation component related to the drive roller 47 may be set to substantially "zero."

Similarly, if a cyclical deviation component by thickness deviation distribution of the intermediate transfer belt 41 in a circumferential direction may be included in a time-pitch error for speed-deviation checking image, the length Pa of the speed-deviation checking image may be preferably set as below.

Specifically, the length Pa of the speed-deviation checking image may be obtained by (1) multiplying the circumference length of photoconductor 3 with a integral number (e.g., one, two, three times), and (2) selecting a value which is most closer to one lap of the intermediate transfer belt 41 from such integrally multiplied values.

With such setting, an effect of cyclical deviation component of intermediate transfer belt 41 may be reduced or suppressed.

Furthermore, a cyclical deviation component of a motor (not shown), which drives the drive roller 47, may have a different frequency with respect to a cyclical deviation component of photoconductor 3. If such cyclical deviation component of the drive motor (not shown) may become ten-times or more of a cyclical deviation component of photoconductor 3, for example, such cyclical deviation component of the drive motor may be removed by a low-pass filter, for example.

A pulse width for each of pulse data, stored in the memory circuit 143, may vary depending on light intensity of light, which is received by the light receiver of the optical sensor unit 136.

The light intensity of light, received by the light receiver, may vary depending on a concentration level of toner image formed on the immediate transfer belt 41.

Accordingly, the pulse width for each of pulse data, stored in the memory circuit 143, may vary depending on a concentration of toner image formed on the immediate transfer belt 41.

In case of timing adjustment control and speed-deviation checking, each toner image in the detection image PV or speed-deviation checking image may need to be detected with higher precision.

When to conduct such image detection with higher precision, the CPU 146 may need to recognize a position of each of pulses even if each pulse may have a different shape in pulse width as shown in FIG. 15*b* and 15*c*.

Figure 15:
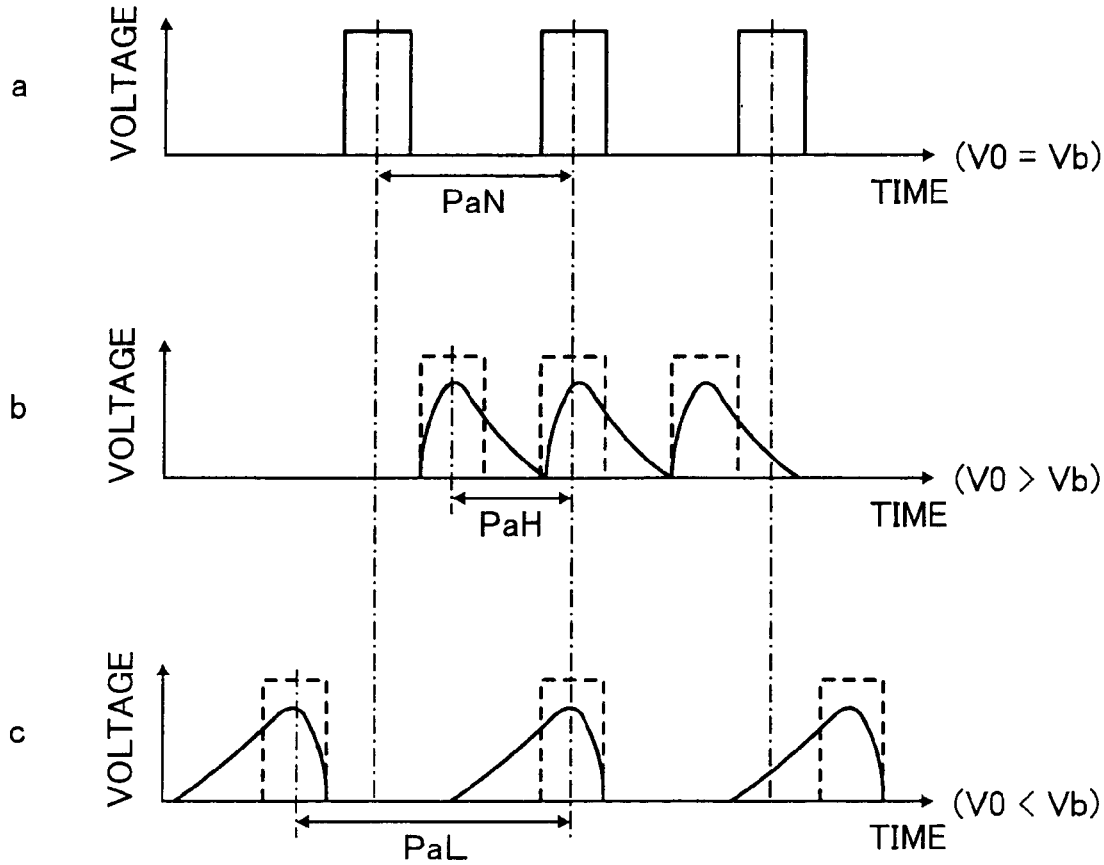
FIGS. 15*a*, 15*b*, and 15*c* are graphs showing output pulses of an optical sensor unit, which detects toner images formed on an intermediate transfer belt.

As shown in FIG. 15, each of pulses, having different width, may correspond to each of toner images formed on the intermediate transfer belt 41.

If the CPU 146 may recognize a pulse using a pulse width that exceeds a given threshold value, the CPU 146 may not detect toner images formed on the intermediate transfer belt 41 with higher precision in some cases shown in FIGS. 15*b* and 15*c*, for example.

In view of such situation, in the image forming apparatus 1000, the CPU 146 may recognize a pulse using a pulse peak position instead of pulse width, for example.

With such configuration, the CPU 146 may more precisely recognize a pulse even if an image forming timing on the intermediate transfer belt 41 from the photoconductor 3 may be deviated from an optimal timing by a speed deviation of the photoconductor 3.

Hereinafter, the above-explained pulse is explained in detail with reference to FIGS. 14 and FIG. 15.

Figure 14:
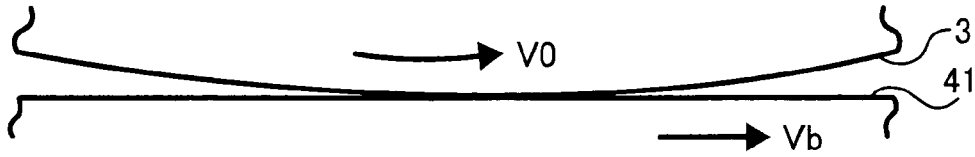
FIG. 14 is an expanded view of a primary transfer nip defined by a photoconductor and intermediate transfer belt.

FIG. 14 is an expanded view of a primary transfer nip between the photoconductor 3 and intermediate transfer belt 41. FIGS. 15*a*, 15*b*, and 15*c* are graphs showing pulses output from the optical sensor unit 136.

FIG. 15*a* is a graph showing an output pulse from the optical sensor unit 136 used for detecting a toner image, which is transferred to the intermediate transfer belt 41 when the photoconductor 3 and intermediate transfer belt 41 has no substantial difference between their surface speeds.

FIG. 15*b* is a graph showing an output pulse from the optical sensor unit 136 used for detecting a toner image, which is transferred to the intermediate transfer belt 41 when a first surface speed V0 of the photoconductor 3 is faster than a second surface speed Vb of the intermediate transfer belt 41 at the primary transfer nip.

FIG. 15*c* is a graph showing an output pulse from the optical sensor unit 136 used for detecting a toner image, which is transferred to the intermediate transfer belt 41 when a first surface speed V0 of the photoconductor 3 is slower than a second surface speed Vb of the intermediate transfer belt 41 at the primary transfer nip.

At the primary transfer nip, the photoconductor 3 and intermediate transfer belt 41 may move with respective surface speeds while contacting each other at the primary transfer nip.

If the first surface speed V0 of the photoconductor 3 and the second surface speed Vb of the intermediate transfer belt 41 may set to a substantially equal speed, a pulse wave output from the optical sensor unit 136 may have a rectangular shape as shown in FIG. 15*a*. The pulse wave may correspond to a concentration of toner image.

In this condition, each pulse may have an interval PaN shown in FIG. 15*a*.

If the first surface speed V0 of the photoconductor 3 is faster than the second surface speed Vb of the intermediate transfer belt 41, each pulse may have an interval may have an interval PaH shown in FIG. 15*b*, which may be shorter than the interval PaN.

In such a case, a shape of each pulse may have a first mountain shape having a longer tail in a right side as shown in FIG. 15*b*. As shown in FIG. 15*b*, such pulse rises sharply and descents gradually.

Such pulse wave may be generated because toner images may be more condensed in one direction of belt moving direction of the intermediate transfer belt 41 (e.g., rightward in FIG. 15*b*) due to a surface speed difference between the photoconductor 3 and intermediate transfer belt 41. Accordingly, toner images formed on the intermediate transfer belt 41 may have uneven concentration.

If the first surface speed V0 of the photoconductor 3 is slower than the second surface speed Vb of the intermediate transfer belt 41, each pulse may have an interval PaL shown in FIG. 15*c*, which may be longer than the interval PaN.

In such a case, a shape of each pulse may have a second mountain shape having a longer tail in a left side as shown in FIG. 15*c*. As shown in FIG. 15*c*, such pulse rises gradually and descents sharply.

Such pulse wave may be generated because toner images may be more condensed in another direction of belt moving direction of the intermediate transfer belt 41 (e.g., leftward in FIG. 15*b*) due to a surface speed difference between the photoconductor 3 and intermediate transfer belt 41. Accordingly, toner images formed on the intermediate transfer belt 41 may have uneven concentration.

If the CPU 146 may recognize a pulse, corresponding to a toner image formed on the intermediate transfer belt 41, when the pulse peak value exceeds a given threshold value, an unpreferable phenomenon may occur as below.

In case of conditions shown in FIGS. 15*b* and 15*c*, a pulse peak may not exceed a given threshold value due to an effect of the above-mentioned condensed toner image, and thereby the CPU 146 may not detect a toner image. Furthermore, the CPU 146 may not detect a highest concentration area of toner image.

In view of such situation, in the image forming apparatus 1000, a pulse peak itself may be used for detecting a toner image formed on the intermediate transfer belt 41, wherein the pulse peak may take any value.

Specifically, based on data stored in the memory circuit 143, the CPU 146 may recognize a pulse with a pulse peak, and store a recognized timing to the RAM 147 as timing data by assigning a data number.

With such configuration, a time-pitch error may be detected more accurately.

The time-pitch error, stored in the RAM 147 as data, may correspond to a speed deviation of the photoconductor 3 per one revolution.

A faster speed area or lower speed area on the photoconductor 3 per one revolution may occur when an amount of eccentricity, caused by any one of the photoconductor 3, photoconductor gear 133, and a coupling connecting the photoconductor 3 and photoconductor gear 133, may become a greater value.

In other words, a faster speed or lower speed on the photoconductor 3 per one revolution may occur when the above-mentioned eccentricity may become its upper limit or lower limit, for example.

A change of eccentricity may be expressed with a sine-wave pattern having an upper limit and lower limit, for example.

Accordingly, a speed-deviation checking of the photoconductor 3 may be analyzed by relating a pattern or amplitude of sine-wave with a timing when the position sensor 135 detects the marking 134.

Such analysis may be conducted by known analytic methods such as zero crossing method in which average value of all data is set to zero, and a method for analyzing amplitude and phase of deviation component from a peak value, for example.

However, detected data may be susceptible to a noise effect, by which an error may become greater in an unfavorable level when the above-mentioned known methods are used.

Therefore, the image forming apparatus 1000 may employ a quadrature detection method for analyzing amplitude and phase of speed-deviation checking image.

The quadrature detection method may be another known signal analysis method, which may be used for a demodulator circuit in telecommunications sector, for example.

Figure 16:
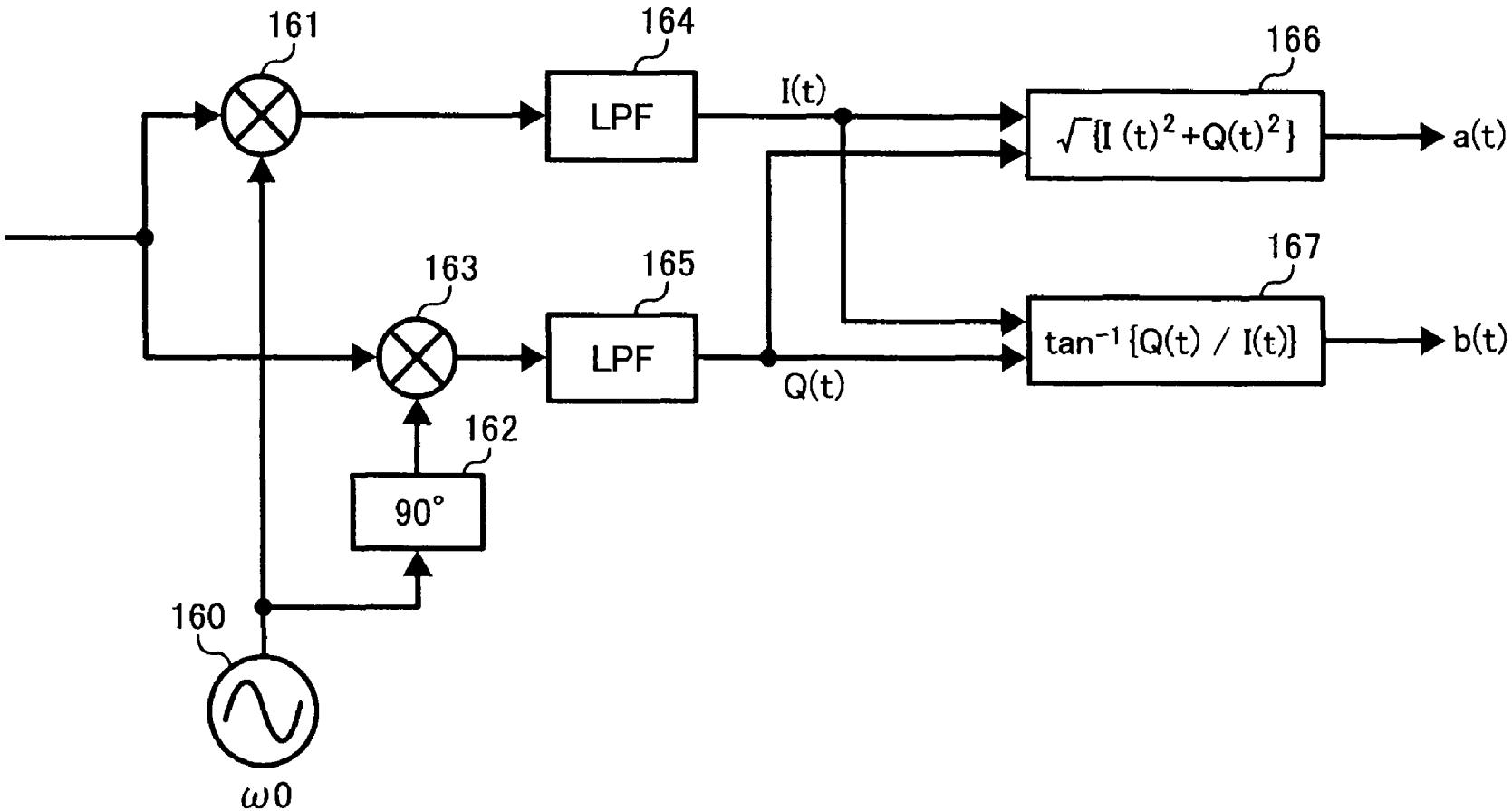
FIG. 16 is a block diagram explaining a circuit configuration for quadrature detection method.

FIG. 16 is an example circuit configuration for conducting the quadrature detection method.

As shown FIG. 16, the circuit configuration may include an oscillator 160, a first multiplier 161, a 90-degree phase shifter 162, a second multiplier 163, a first LPF (low-pass filter) 164, a second LPF (low-pass filter) 165, an amplitude computing unit 166, and a phase computing unit 167, for example.

A signal, output from the optical sensor unit 136, may have a wave shape, and stored in the RAM 147 as data.

Such data may include a speed deviation of the photoconductor 3, and other speed deviation related to other parts such as gear.

Therefore, such data may include various types of speed deviation related to other parts, by which an overall speed deviation may increase over time.

Such various types of speed deviation related to other parts may be extracted from the data, and then the data may be converted to a deviation data.

Such various types of speed deviation related to other parts may be computed by applying least-squares method to the data, and the converted deviation data may be used as multiplication rate correction value, for example.

The converted deviation data may be processed as below.

The oscillator 160 may oscillate a frequency signal, which is to be desirably detected.

In an example embodiment, the oscillator 160 may oscillate such frequency signal, which is adjusted to the frequency ω0 of rotation cycle of image carrier (e.g., photoconductor 3).

The oscillator 160 may oscillate the frequency signal from a phase condition, corresponding to a reference timing when forming the speed-deviation checking image.

When forming the speed-deviation checking image, the oscillator 160 may oscillate the frequency signal ω0 from a given timing (or given phase or position) of the photoconductor 3, for example.

The oscillator 160 may output the frequency signal to the first multiplier 161, or to the second multiplier 163 via the 90-degree phase shifter 162.

The rotation cycle (or frequency signal ω0) of the photoconductor 3 may be measured by detecting the marking 134 on the photoconductor gear 133 with the position sensor 135.

The first multiplier 161 may multiply the deviation data stored in the RAM 147 with the frequency signal, outputted from the oscillator 160.

Furthermore, the second multiplier 163 may multiply the deviation data stored in the RAM 147 with a frequency signal, outputted from the 90-degree phase shifter 162.

With such multiplication, the deviation data may be separated into two components: a phase component (I component) signal, which may correspond to a phase of photoconductor 3; and a quadrature component (Q component) signal, which may not correspond to the phase of photoconductor 3.

The first multiplier 161 may output the I component, and the second multiplier 163 may output the Q component.

The first LPF 164 passes through only a signal having low frequency band pass.

The image forming apparatus 1000 may employ a low-pass filter (e.g., first LPF 164), which smoothes data for the speed-deviation checking image having the length Pa.

With such configuration, the first LPF 164 may only pass data having a cycle, which is obtained by multiplying an rotating cycle (or oscillating cycle) ω0 with an integral number (e.g., one, two, three).

The second LPF 165 may have a similar function as in the first LPF 164.

By smoothing data having the length Pa, a cyclical rotational component of the drive roller 47 or the like may be removed from the deviation data.

The amplitude computing unit 166 may compute an amplitude a(t), which corresponds to two inputs (i.e., I component and Q component).

Furthermore, the phase computing unit 167 may compute a phase b(t), which corresponds to two inputs (i.e., I component and Q component).

Such amplitude a(t) and phase b(t) may correspond to an amplitude of one cycle of the photoconductor 3 and a phase which is angled from a given reference timing of the photoconductor 3.

Furthermore, when to detect amplitude and phase of cyclical rotational component of the drive gear 121, the above-described signal processing may be similarly conducted by setting a rotation cycle of the drive gear 121 to the oscillating cycle of ω0.

By conducting such quadrature detection method, amplitude and phase can be computed with a smaller amount of deviation data, which may be difficult by a zero crossing method or a method for detecting a pulse with a threshold value, for example.

Specifically, with respect to one rotational cycle of the photoconductor 3, a number of toner images in a speed-deviation checking image may be set to "4N" (N is a natural number) by adjusting the pitch PS of toner images.

With such adjustment and setting, amplitude and phase can be computed with higher precision with a smaller number of toner images.

Such computation of the amplitude and phase with higher precision using a smaller number of toner images may become possible because a positional relationship of toner images having a number of 4N may be less affected by a deviation component, and thereby an image detection sensitivity become higher.

For example, in case of four toner images, each of toner images may correspond to a zero cross position and peak position of deviation component, by which detection sensitivity may become higher. Accordingly, even if a phase of each toner image may have a deviation with each other, such toner images may have a positional relationship having higher detection sensitivity.

Based on such analysis on speed-deviation checking, the CPU 146 may compute drive-control correction data for the photoconductors 3Y, 3C, 3M and 3K 3, and transmit the drive-control correction data to the drive controller 150.

Based on the drive-control correction data, the drive controller 150 may adjust a rotational phase of the photoconductors 3Y, 3C, 3M and 3K to reduce a phase difference among the photoconductors 3Y, 3C, 3M and 3K.

For example, if each of the photoconductors 3Y, 3C, 3M and 3K may have phases, which may be expressed by a sine-wave pattern, the drive controller 150 may adjust a rotational phase of the photoconductors 3Y, 3C, 3M and 3K so that the photoconductors 3Y, 3C, 3M and 3K may rotate from a substantially same position.

Accordingly, each phase of the photoconductors 3Y, 3C, 3M and 3K, which may be expressed by a sine-wave pattern, may be adjusted each other, by which a relative positional deviation of superimposed toner images may be reduced.

Based on the speed-deviation checking, which detects a speed deviation of the photoconductors 3Y, 3C, 3M and 3K, the above-explained drive-control correction data corresponding to the speed deviation of the photoconductors 3Y, 3C, 3M and 3K may be computed.

Such drive-control correction data may be used for a phase adjustment control, which adjusts a phase of the photoconductors 3Y, 3C, 3M and 3K.

With such phase adjustment control of the photoconductors 3Y, 3C, 3M and 3K, toner images that may not be normally transferred as shown in FIGS. 15*b* and 15*c* may be formed on the surface of intermediate transfer belt 41 in a normal manner.

In the image forming apparatus 1000, a pitch between adjacent photoconductors 3Y, 3C, 3M and 3K may be set to one times of the circumference length of the photoconductor 3, by which a phase of the photoconductors 3Y, 3C, 3M and 3K may be synchronized each other.

In other words, a driving time of each of the process drive motor 120Y, 120C, 120M, and 120K may be temporarily changed so that a surface speed of each of the photoconductors 3Y, 3C, 3M and 3K photoconductor may become faster speed or lower speed at a substantially same timing.

With such configuration, toner images that may not be normally transferred as shown in FIGS. 15*b* and 15*c* may be formed on the surface of intermediate transfer belt 41 in a normal manner.

In the image forming apparatus 1000, such phase adjustment control may be conducted when each job completes. The job may include a printing job, for example.

The phase adjustment control can be conducted before starting such job (e.g., printing job). However, such process may delay a start of first printing because a phase adjustment control is conducted between a job-activation and a printing operation for a first sheet.

Accordingly, the phase adjustment control may be preferably conducted after completing a job (e.g., printing job).

Such configuration may preferably reduce a first printing time, and may set a preferable phase relationship among the photoconductors 3Y, 3C, 3M and 3K for a next printing job.

Therefore, each of the photoconductors 3Y, 3C, 3M and 3K may be driven under a preferable phase relationship for a next job (e.g., printing job).

In general, an image forming apparatus may receive an environmental effect such as temperature change and external force, for example.

If such environmental effect may occur to the image forming apparatus, a position or shape of process units in the image forming apparatus may change.

Such external force may occur to the process units in the image forming apparatus by several reasons such as sheet jamming correction, parts replacement during maintenance, moving of image forming apparatus from one place to another place, for example.

If such external force and temperature change may occur to the process units, each color toner image may not be superimposed on an intermediate transfer belt in a precise manner.

In view of such situation, the image forming apparatus 1000 may conduct a timing adjustment control at a given timing to reduce a superimposing-deviation of each toner images.

Such given timing may include a time right after a power-switch of the image forming apparatus 1000 is set to ON condition, and a given timing which has lapsed after supplying power to the image forming apparatus 1000, for example.

In the image forming apparatus 1000, four light beams may be used for irradiating the respective photoconductors 3Y, 3C, 3M, and 3K.

Such light beams may be deflected by one common polygon mirror (i.e., polygon mirror 21), and then each of the light beams may scan each of the photoconductors 3Y, 3C, 3M, and 3K in a main scanning direction.

In such configuration, an optical-writing starting timing for each of the photoconductors 3Y, 3C, 3M, and 3K may be adjusted with a time value, obtained by multiplying a writing time of one line (i.e., one scanning line) with an integral number (e.g., one, two, three) when the timing adjustment control is conducted.

For example, assume that two photoconductors may have a superimposing-deviation in the sub-scanning direction (or surface moving direction of photoconductor 3) by more than "½ dot."

In this case, an optical-writing starting timing for one of the photoconductors may be delayed or advanced for a time value, which is obtained by multiplying a writing time for one line with integral numbers (e.g., one, two, three times).

Specifically, when a superimposing-deviation amount in a sub-scanning direction is "¾ dot," an optical-writing starting timing may be delayed or advanced for a time value, obtained by multiplying a writing time for one line with one.

When a superimposing-deviation amount in a sub-scanning direction is "7/4 dot," an optical-writing starting timing may be delayed or advanced for a time value, obtained by multiplying a writing time for one line with two.

With such controlling, a superimposing-deviation in sub-scanning direction may be suppressed ½ dot or less, for example.

However, if a superimposing-deviation amount in a sub-scanning direction is less than "½ dot," the above-explained method that delaying or advancing an optical-writing starting timing with a time value, obtained by multiplying a writing time for one line with integral number, may unpreferably increase the superimposing-deviation amount.

Accordingly, if a superimposing-deviation amount in a sub-scanning direction is less than ½ dot, an adjustment of optical-writing starting timing may not be conducted with the above-explained method that delaying or advancing an optical-writing starting timing with a time value, obtained by multiplying a writing time for one line with integral number.

As such, a superimposing-deviation of less than ½ dot may not be reduced by a timing adjustment control.

However, for coping with a recent market need for enhanced image quality, a superimposing-deviation of less than ½ dot may need to be reduced or suppressed.

In the image forming apparatus 1000, if a superimposing-deviation of less than ½ dot may be detected in the timing adjustment control, the CPU 146 may compute a drive-speed correction value corresponding to a deviation amount, and stores the computed drive speed correction value to the drive controller 150.

When conducting a printing job in the image forming apparatus 1000, each of the photoconductors 3Y, 3C, 3M and 3K may be driven with a drive speed based on the computed drive-speed correction value. The printing job may be instructed from an external apparatus such as personal computer, which transmits image information to the image forming apparatus 1000, for example.

With such controlling for printing job, each of the photoconductors 3Y, 3M, 3C, and 3K may have a different linear velocity among the photoconductors 3Y, 3M, 3C, and 3K to reduce a superimposing-deviation of less than ½ dot, as required. Accordingly, a superimposing-deviation amount may be reduced to less than ½ dot.

However, if each of the photoconductors 3Y, 3M, 3C, and 3K may have a different linear velocity, a phase relationship of the photoconductors 3Y, 3M, 3C, and 3K may deviate from a preferable relationship with a rotation of each of the photoconductors 3Y, 3M, 3C, and 3K.

If a printing operation is conducted only one time, such phase deviation of the photoconductors 3Y, 3M, 3C, and 3K may not cause a significant trouble.

However, if a continuous printing operation is conducted to a plurality of recording sheets continuously, deviations of phase relationship of the photoconductors 3Y, 3M, 3C, and 3K may be accumulated when a number of printing sheets are increased, and a phase deviation may become unpreferably larger due to the accumulated deviations of phase relationship of the photoconductors 3Y, 3M, 3C, and 3K.

In view of such situations, the image forming apparatus 1000 may include an image quality mode and a speed, for example.

The image quality mode may set a priority on an image quality. The speed mode may set a priority on a printing speed. The image quality mode and speed mode may be selectable by operating a key on an operating panel (not shown) or by a print driver of a personal computer, for example.

If a continuous printing operation is conducted while selecting the image quality mode, the continuous printing job may be suspended at a given timing (e.g., when a given number of sheets are continuously printed) to conduct a phase adjustment control at such given timing.

As such, a superimposing-deviation of less than ½ dot may be reduced by the image forming apparatus 1000.

In case of conducting a speed-deviation checking, each of the photoconductors 3Y, 3M, 3C, and 3K may be driven with one similar speed (i.e., a difference between the linear velocity of the photoconductors 3Y, 3M, 3C, and 3K may be set to substantially zero).

With such configuration, a speed-deviation checking image for each of the photoconductors 3Y, 3M, 3C, and 3K may be detected with a similar precision level because the photoconductors 3Y, 3M, 3C, and 3K may not have a different linear velocity.

If the photoconductors 3Y, 3M, 3C, and 3K may have different linear velocity each other, one cycle rotation for each of the photoconductors 3Y, 3M, 3C, and 3K may deviate each other. If such cycle for each of the photoconductors 3Y, 3M, 3C, and 3K may become an undesired value, a computation result by quadrature detection method may have an error.

In general, a speed-deviation of photoconductor 3 per one revolution may less likely receive an effect of temperature change and external force.

Therefore, the speed-deviation checking for photoconductor 3 may be conducted with less frequency (e.g. longer time interval between adjacent checking operations) compared to the timing adjustment control.

However, if the process unit 1 is replaced from the image forming apparatus 1000, a speed-deviation of the photoconductor 3 may change relatively greater.

In such a situation of the image forming apparatus 1000, a speed-deviation checking may be conducted when any one of the process units 1Y, 1C, 1M, and 1*k* may be replaced, for example.

For example, a replacement detector 80 (see FIG. 1) or a unit sensor may be provided to the each of the process units 1Y, 1C, 1M, and 1*k* to detect a replacement of the process unit 1.

The unit sensor (not shown) may transmit a signal to the replacement detector 80 that the process unit 1 is replaced with a new one by changing the signal from "OFF" to "ON" when the process unit 1 is replaced.

The replacement detector 80 may judge that the process unit 1 is replaced when the replacement detector 80 receives such signal from the unit sensor.

Furthermore, the process unit 1 may include an electric circuit board having an IC (integrated circuit), which may store a unit ID (identification) number. The electric circuit board may be coupled to the CPU 146.

When the process unit 1 is replaced with new one, a unit ID number may also be changed because each process unit 1 may have unique unit ID number. The replacement detector 80 may detect a change of unit ID number to recognize a replacement of the process unit 1.

In the image forming apparatus 1000, a speed-deviation checking and phase adjustment control may be conducted with a timing adjustment control as one set.

Specifically, when a replacement of process unit 1 is detected, a timing adjustment control may be conducted, and then a speed-deviation checking and a phase adjustment control may be conducted. Then, another timing adjustment control may be conducted again.

During such control process, a printing job may not be conducted.

Hereinafter, such a control process to be conducted after replacing the process unit 1 may be referred to after-replacement control, as required.

In the image forming apparatus 1000, the after-replacement control may be conducted as below.

At first, a first timing adjustment control may be conducted. Then, each of the photoconductors 3Y, 3M, 3C, and 3K may be stopped before conducting a speed-deviation checking.

In this case, each of the photoconductors 3Y, 3M, 3C, and 3K may not be stopped by a phase relationship of the photoconductors 3Y, 3M, 3C, and 3K that the photoconductors 3Y, 3M, 3C, and 3K have before the replacement of the process unit 1.

Instead, each of the photoconductors 3Y, 3M, 3C, and 3K may be stopped at a reference phase position, which is set in the image forming apparatus 1000.

Specifically, each of process drive motor 120Y, 120M, 120C, and 120K may be stopped at a reference timing which comes in at a given time period after the photosensor 135 detects the marking 134 on the photoconductor gear 133.

For example, the photoconductor 3K may be used as a reference photoconductor, and a reference timing may be determined with the photoconductor 3K.

With such controlling, each of the photoconductors 3Y, 3M, 3C, and 3K may stop under a condition that the marking 134 on each photoconductor gear 133 may be positioned to a similar rotational angle position.

With such stopping of the photoconductors 3Y, 3M, 3C, and 3K, a speed-deviation checking may be conducted by rotating each of the photoconductors 3Y, 3M, 3C, and 3K from a similar rotational angle position.

In case of speed-deviation checking, speed-deviation checking images of Y, C, and M may be formed with speed-deviation checking image of K.

Then, each of the speed-deviation checking images of Y, C, and M and speed-deviation checking image of K may be concurrently detected with the optical sensor unit 136.

The photoconductor 3K may be used as reference image carrier for adjusting speed deviation of the photoconductors 3Y, 3M, 3C, and 3K.

In such configuration, a phase of the photoconductors 3Y, 3C, and 3M may be matched to a phase of the photoconductor 3K. With such configuration, a speed deviation component of the intermediate transfer belt 41 may less likely to affect the phase of the photoconductors 3Y, 3M, 3C, and 3K.

Specifically, a speed deviation may include a speed deviation of the intermediate transfer belt 41 at a position facing the optical sensor unit 136 in addition to the speed deviation of the photoconductors 3Y, 3M, 3C, and 3K.

Accordingly, even if speed-deviation checking images are formed on the intermediate transfer belt 41 with an equal pitch each other, a time-pitch error may occur to the speed-deviation checking images if a moving speed of the intermediate transfer belt 41 may change.

To reduce such time-pitch error, a speed-deviation checking image of K (i.e., reference image) and a speed-deviation checking image of Y, M, and C may need to be detected concurrently.

Accordingly, in the image forming apparatus 1000, a speed-deviation checking image of one of Y, C, or M, and a speed-deviation checking image of K may be formed on the intermediate transfer belt 41 as one set.

In the image forming apparatus 1000, the speed-deviation checking image of K may be formed on the first lateral side of the intermediate transfer belt 41, and the speed-deviation checking image of one of Y, C, or M may be formed on the second lateral side of the intermediate transfer belt 41.

The speed-deviation checking image of K may be formed at a timing that the marking 134K is detected by the photosensor 135K.

Furthermore, the speed-deviation checking images of Y, C, and M may be formed from a timing that the photosensor 135K detects the marking 134K instead of a timing that the photosensor 135Y, 135C, and 135M detect the markings 134Y, 134C, and 134M, respectively.

With such controlling, a front edge of the speed-deviation checking images of Y, C, and M and a front edge of the speed-deviation checking image of K may be aligned in a width direction of the intermediate transfer belt 41.

Then, a phase difference between the image of K and the image of other one of Y, C, or M may be detected.

Accordingly, a phase alignment of speed-deviation checking images of K and one of Y, C, M may be conducted by shifting a position of marking 134K with respect to the markings 134Y, 134C, 134M based on the phase difference obtained from the above-described process.

Then, a speed-deviation checking may be conducted without using a detection timing that the position sensors 135Y, 135C, and 135M detects the markings 134Y, 134C, and 134M.

Specifically, a phase deviation between the speed-deviation checking image of one of Y, C, and M and speed-deviation checking image of K may be detected.

However, if the process unit 1 is replaced with a new one, a superimposing-deviation of toner images may become larger than before replacing the process unit 1. In such a case, a detection result of the phase deviation may shift with such superimposing-deviation.

Therefore, in the image forming apparatus 1000, a timing adjustment control may be conducted before a speed-deviation checking to reduce a superimposing-deviation of toner images.

Hereinafter, a process for the above-described after-replacement control is explained with reference to FIG. 17.

Figure 17A:
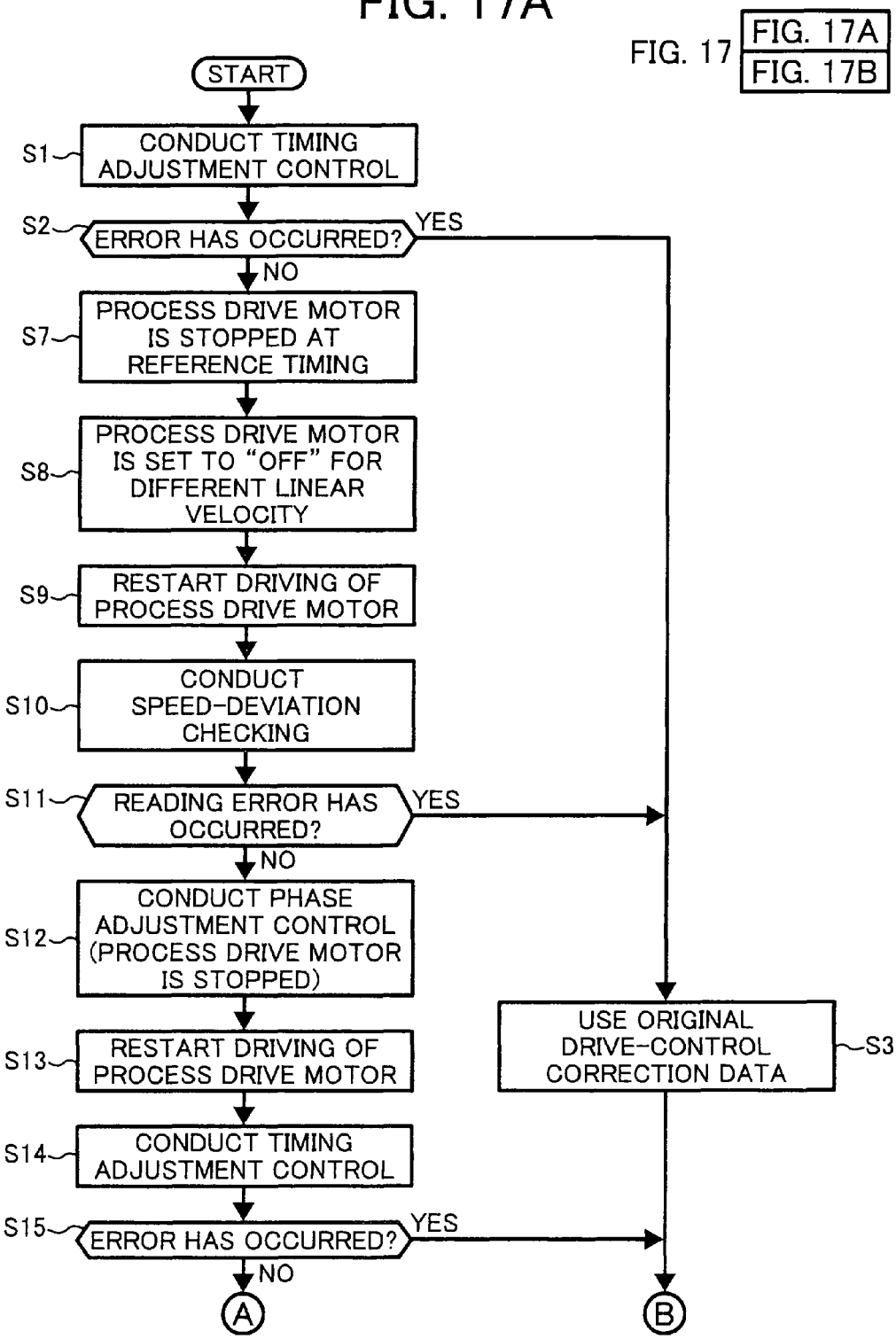
FIGS. 17A and 17B are a flow chart for explaining a process to be conducted after detecting a replacement of a process unit and before conducting a printing job.
Figure 17B:
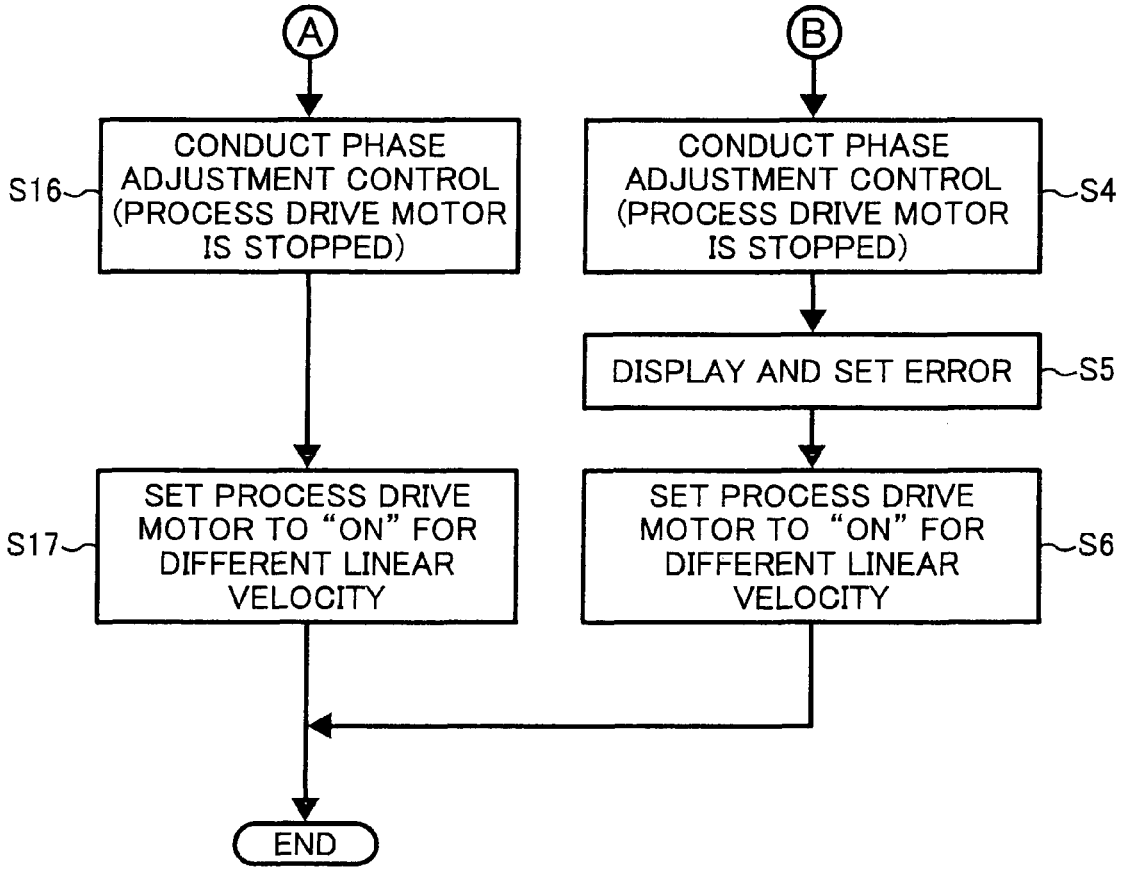

FIG. 17 is a flow chart for explaining a control process to be conducted after detecting a replacement of the process unit 1 and before conducting a printing job.

A replacement of the process units 1 may be detected when one process units 1 is replaced from the image forming apparatus 1000.

At step S1, the CPU 146 conducts a timing adjustment control.

At step S2, the CPU 146 checks whether an error has occurred. If the CPU 146 confirms the error has occurred at step S2, the process goes to step S3.

Such error may include that image reading is impossible, abnormal value is read, and correction is failed, for example.

At step S3, the CPU 146 uses an original drive-control correction data for adjusting a phase of each of the photoconductors 3Y, 3C, 3M, and 3K. In this case, the original drive-control correction data may mean data that the process unit 1 has before the replacement.

Then, the CPU 146 conducts a phase adjustment control at step S4.

In the phase adjustment control, each of the photoconductors 3Y, 3C, 3M, and 3K is stopped while synchronizing phases of the photoconductors 3Y, 3C, 3M, and 3K based on the original drive-control correction data, and the CPU 146 displays an error on an operating panel (not shown) at step S5.

At step S6, the CPU 146 sets different linear velocities to each of the process drive motors 120Y, 120M, 120C, and 120K (i.e., setting of different linear velocities is set to ON). Then, the control process ends.

Because the CPU 146 sets the different linear velocities to each of the process drive motors 120Y, 120M, 120C, and 120K, each of the photoconductors 3Y, 3C, 3M, and 3K is set with different linear velocities to reduce a superimposing-deviation of less than ½ dot for a printing job. The printing job will be conducted after completing the process shown in FIG. 17.

If the CPU 146 confirms the error has not occurred at step S2, the process goes to step S7.

At step S7, the CPU 146 stops each of the process drive motors 120Y, 120C, 120M, and 120K at a given reference timing, in which each of the photoconductor gears 133Y, 133C, 133M, and 133K may be stopped while positioning the markings 134Y, 134C, 134M, and 134K on the respective photoconductor gears 133Y, 133C, 133M, and 133K at a similar same rotational angle.

Then, at step S8, the CPU 146 cancels the setting of the different linear velocities to each of the process drive motors 120Y, 120M, 120C, and 120K (i.e., setting of different linear velocities is set to OFF).

At step S9, the CPU 146 restarts a driving of process drive motors 120Y, 120C, 120M, and 120K.

At step S10, the CPU 146 conducts a speed-deviation checking.

Because the CPU 146 cancels the setting of the different linear velocities to each of the process drive motors 120Y, 120M, 120C, and 120K at step S8, each of the photoconductors 3Y, 3C, 3M, and 3K is driven with a similar speed during the speed-deviation checking.

Accordingly, a speed-deviation checking of the photoconductors 3Y, 3C, 3M, and 3K may be conducted at a higher precision because each of the photoconductors 3Y, 3C, 3M, and 3K is driven with the similar speed during the speed-deviation checking.

When the speed-deviation checking has completed, the CPU 146 checks whether a reading error has occurred at step S11.

For example, the reading error may include that a number of read image patters are not matched to a number of actually formed latent image, wherein such phenomenon may be caused when a scratch on the belt is read, or when a toner image formed on the belt has a very faint concentration which may be too faint for reading.

If the CPU 146 confirms that the reading error has occurred at step S11, the above-explained steps S2 to S6 are conducted, and the control process ends.

If the CPU 146 confirms that the reading error has not occurred at step S11, the process goes to step S12.

At step S12, the CPU 146 conducts a phase adjustment control, and sets a new drive-control correction data.

At step S12, the CPU 146 stops each of the photoconductors 3Y, 3C, 3M, and 3K while synchronizing a phase of the photoconductors 3Y, 3C, 3M, and 3K using the new drive-control correction data.

At step S13, the CPU 146 restarts a driving of process drive motors 120Y, 120C, 120M, and 120K.

At step S14, the CPU 146 conducts a second timing adjustment control.

The CPU 146 conducts such second timing adjustment control to correct an optical-writing starting timing for each of the photoconductors 3Y, 3C, 3M, and 3K because the optical-writing starting timing may be in unfavorable timing condition due to the replacement of the process unit 1.

At step S15, the CPU 146 checks whether an error has occurred. If the CPU 146 confirms that the error has occurred at step S15, the process goes to the above-mentioned steps S4 to S6, and the control process ends.

If the CPU 146 confirms that the error has not occurred at step S15, the process goes to step S16.

At step S16, the CPU 146 stops each of the process drive motors 120Y, 120C, 120M, and 120K for a phase adjustment control.

At step S17, the CPU 146 sets different linear velocities to each of the process drive motors 120Y, 120M, 120C, and 120K (i.e., setting of different linear velocities is set to ON). Then, the control process ends.

With such controlling process, the image forming apparatus 1000 may produce an image by reducing superimposing-deviation of images.

In the above-discussion, the image forming apparatus 1000 employs an intermediate transfer method to transfer toner images to a recording medium (e.g., sheet), in which toner images on the photoconductors 3Y, 3C, 3M, and 3K are primary transferred onto the intermediate transfer belt 41, and then secondary transferred onto the recording medium.

However, the image forming apparatus 1000 may employ a directly transfer method to transfer toner images to a the recording medium, in which toner images on photoconductors 3Y, 3C, 3M, and 3K are directly and superimposingly transferred onto the recording medium transported on a sheet transport belt, which travels in a endless manner.

In such a configuration, a timing adjustment control and speed-deviation checking may be conducted with transferring each toner image on the sheet transport belt and detecting each toner image with the optical sensor unit 136.

Numerous additional modifications and variations are possible in light of the above teachings. It is therefore to be understood that within the scope of the appended claims, the disclosure of the present invention may be practiced otherwise than as specifically described herein.

What is claimed is:

1. An image forming apparatus, comprising:

a plurality of image carriers to carry an image thereon;

a plurality of drivers configured to drive each of the plurality of image carriers;

a plurality of drive-force transmitting members configured to transmit a driving-force from the plurality of drivers to the plurality of image carriers;

a developing unit, provided to each of the plurality of image carriers, configured to develop the image on each of the plurality of image carriers;

a transfer member, being faced to the plurality of image carriers, configured to receive the developed image from each of the plurality of image carriers sequentially while endlessly moving in a given direction;

an image detector configured to detect a detection image in the developed image formed on the transfer member in order to check a detection timing of the developed image;

a sensor, provided to each of the plurality of image carriers, configured to detect a rotational speed of each of the plurality of image carriers and to determine a rotational angle of each of the plurality of image carriers; and a controller configured to conduct an image-to-image displacement control, a speed-deviation checking, and a phase adjustment control, the image-to-image displacement control including an image forming of the detection image on the transfer member, the detection image including an image transferred from all of the plurality of image carriers so that the transferred images from all of the plurality of image carriers are spaced apart on the transfer member, a detection of the detection image with the image detector, and an adjustment of image forming timing on each of the plurality of image carriers based on distances between the transferred images spaced apart on the transfer member;

wherein the speed-deviation checking includes image forming of a speed-deviation checking image on the transfer member transferred from all of the plurality of image carriers, the speed-deviation checking image including the image transferred from all of the plurality of image carriers so that the transferred images from all of the plurality of image carriers are spaced apart on the transfer member, detecting the speed-deviation checking image with the image detector, and determining a speed-deviation of each of the plurality of image carriers per one revolution based on a result detected by the image detector and a result detected by the sensor, wherein the phase adjustment control includes a phase adjustment of each of the plurality of image carriers based on a result determined by the speed-deviation checking, and wherein the controller conducts the phase adjustment control and the image-to-image displacement control before conducting an image forming operation on each of the plurality of image carriers.

2. The image forming apparatus according to claim 1, wherein after forming the speed-deviation checking image on the transfer member, the controller conducts phase adjustment control by adjusting a phase of each of the plurality of image carriers based on the result determined by the speed-deviation checking for each of the plurality of image carriers, and deactivates each of the plurality of drivers, by which the controller adjusts a phase of each of the plurality of image carriers before each of the plurality of drivers is re-activated.

3. The image forming apparatus according to claim 2, wherein in the speed-deviation checking, a first speed-deviation checking image is formed on a first image carrier designated as reference image carrier from the plurality of image carriers, and a second speed-deviation checking image is formed on a second image carrier, the second image carrier is any one of the plurality of the image carriers excluding the reference image carrier, the first and second speed-deviation checking images are transferred to the transfer member in a parallel manner on each lateral side of the transfer member and perpendicularly to a surface moving direction of the transfer member, the controller determines an image forming timing of the first speed-deviation checking image on the first image carrier based on a result detected by the sensor, and determines an image forming timing of the second speed-deviation checking image on the second image carrier based also on the result detected by the sensor, and the controller determines a deactivation timing of a driver for driving the second image carrier, the driver corresponds to one of the plurality of drivers, based on a phase difference of the first and second image carriers determined by the speed-deviation checking.

4. The image forming apparatus according to claim 3, wherein the controller conducts an image-to-image displacement control, a speed-deviation checking, and a phase adjustment control sequentially; deactivates each of the plurality of drivers; re-activates each of the plurality of drivers; and further conducts another image-to-image displacement control.

5. The image forming apparatus according to claim 3, wherein the controller activates the driver for driving the second image carrier; deactivates the driver for driving the second image carrier at a given reference timing instead of the deactivation timing set for the driver for driving the second image carrier; and re-activates the driver for driving the second image carrier before conducting the speed-deviation checking.

6. The image forming apparatus according to claim 2, wherein the controller sets a driving speed for each of the plurality of drivers independently based on a detection timing of the developed image in the detection image, and the controller drives each of the plurality of drivers with the independently-set driving speed when conducting an image forming operation.

7. The image forming apparatus according to claim 6, wherein the controller drives each of the plurality of drivers with a substantially similar drive speed when conducting the speed-deviation checking.

8. The image forming apparatus according to claim 1, wherein the controller conducts a quadrature detection method to an output signal, transmitted from the image detector, to analyze the speed-deviation checking image.

9. The image forming apparatus according to claim 1, further comprising a replacement detector provided to at least one of each of the plurality of image carriers and each of the plurality of drive-force transmitting members, the replacement detector being configured to detect a replacement of at least one of one of the plurality of image carriers and one of the plurality of drive-force transmitting members, and wherein the controller sequentially conducts the speed-deviation checking, the phase adjustment control, and the image-to-image displacement control when the replacement detector detects a replacement of one of at least one of the plurality of image carriers and drive-force transmitting members.

10. The image forming apparatus according to claim 1, wherein the transfer member includes any one of an intermediate transfer belt and a recording medium.

11. The apparatus according to claim 1, wherein the apparatus comprises four image carriers.

12. The apparatus according to claim 1, wherein a first image carrier of the plurality of image carriers corresponds to black images.

13. The apparatus according to claim 1, wherein an image carrier of the plurality of image carriers corresponds to cyan images, wherein another image carrier of the plurality of image carriers corresponds to magenta images, and wherein yet another image carrier of the plurality of image carriers corresponds to yellow images.

14. The apparatus according to claim 1, wherein an image carrier of the plurality of image carriers corresponds to black images, wherein another image carrier of the plurality of image carriers corresponds to cyan images, wherein yet another image carrier of the plurality of image carriers corresponds to magenta images, and wherein still another image carrier of the plurality of image carriers corresponds to yellow images.

15. The apparatus according to claim 1, wherein the apparatus employs a quadrature detection method for analyzing amplitude and phase of the speed-deviation checking image.

* * * * *